US009388674B2

(12) United States Patent
Mitchell et al.

(10) Patent No.: US 9,388,674 B2
(45) Date of Patent: Jul. 12, 2016

(54) CASING PERFORATING AND EROSION SYSTEM FOR CAVERN EROSION IN A HEAVY OIL FORMATION AND METHOD OF USE

(71) Applicants: Bruce Mitchell, Calgary (CA); Richard Bennett, Springbank (CA)

(72) Inventors: Bruce Mitchell, Calgary (CA); Richard Bennett, Springbank (CA)

( * ) Notice: Subject to any disclaimer, the term of this patent is extended or adjusted under 35 U.S.C. 154(b) by 69 days.

(21) Appl. No.: 14/341,124

(22) Filed: Jul. 25, 2014

(65) Prior Publication Data

US 2015/0027695 A1 Jan. 29, 2015

Related U.S. Application Data

(60) Provisional application No. 61/858,542, filed on Jul. 25, 2013.

(51) Int. Cl.

| | |
|---|---|
| ***E21B 43/119*** | (2006.01) |
| ***E21B 43/26*** | (2006.01) |
| ***B24C 1/04*** | (2006.01) |

(52) U.S. Cl.

CPC ..... *E21B 43/119* (2013.01); *B24C 1/045* (2013.01); *E21B 43/26* (2013.01)

(58) Field of Classification Search

CPC ... E21B 23/04; E21B 43/26; E21B 2023/008; E21B 4/18; E21B 43/116; E21B 43/117; E21B 17/20; E21B 17/206; E21B 43/114

See application file for complete search history.

(56) References Cited

U.S. PATENT DOCUMENTS

| | | | | |
|---|---|---|---|---|
| 3,593,797 | A * | 7/1971 | Lebourg | E21B 33/138 166/286 |
| 4,346,761 | A | 8/1982 | Skinner et al. | |
| 4,756,371 | A | 7/1988 | Brieger | |
| 4,765,173 | A | 8/1988 | Schellstede | |
| 5,335,724 | A | 8/1994 | Venditto et al. | |
| 5,445,220 | A | 8/1995 | Gurevich et al. | |
| 6,651,741 | B2 | 11/2003 | Bassin et al. | |
| 7,497,259 | B2 | 3/2009 | Leising et al. | |
| 7,918,279 | B2 | 4/2011 | Leising et al. | |
| 8,528,644 | B2 | 9/2013 | Brunet et al. | |
| 2002/0007949 | A1 * | 1/2002 | Tolman | E21B 33/124 166/308.1 |
| 2003/0075361 | A1 * | 4/2003 | Terry | G01V 3/30 175/61 |

FOREIGN PATENT DOCUMENTS

WO 2012/059859 A1 5/2012

* cited by examiner

*Primary Examiner* — Zakiya W Bates

(74) *Attorney, Agent, or Firm* — Parlee McLaws LLP (CGY); Linda M Thompson

(57) ABSTRACT

A system and method for forming a cavern in a formation beyond a cased wellbore utilizes a locator to position a perforating gun in the wellbore for forming axially aligned, spaced-apart perforations through the casing. The locator has a stationary portion, run in and anchored in the wellbore below a zone of interest. The perforating guns have a moveable portion of the locator at a downhole end and are run in and coupled with the stationary portion. Where two or more guns are used to form the perforations, the guns are indexed relative to one another for forming the offset perforations. The guns are tripped from the wellbore and a wash tool having a moveable portion of the locator at a downhole end is run in and coupled in the wellbore. The locator acts to delimit a reciprocation of the wash tool along the space-apart perforations for delivering a non-abrasive fluid therethrough for forming the cavern.

20 Claims, 16 Drawing Sheets

CASING PERFORATING AND EROSION SYSTEM FOR CAVERN EROSION IN A HEAVY OIL FORMATION AND METHOD OF USE

CROSS-REFERENCE TO RELATED APPLICATIONS

This application claims the benefit under 35 USC §119 of U.S. Provisional Patent Application 61/858,542, filed Jul. 25, 2013, the entirety of which is incorporated herein by reference.

FIELD

Embodiments disclosed herein relate to apparatus and methods for forming openings in a casing of a wellbore and, more particularly, to positioning of the openings therein and eroding a cavern in a formation therebeyond.

BACKGROUND

Wellbores are drilled through formations having one or more zones of interest for production of a hydrocarbon resource therethrough. The wellbores may be cased and cemented, particularly where the formation is unconsolidated and may otherwise collapse. In order to effect production of resources such as heavy oil, at a minimum perforations must be made through the casing and cement to provide a fluid path between the formation and the wellbore.

It is well known to use perforating guns to create generally cylindrical holes through the casing, which is typically a metal tubular. The perforations created have a limited size. Further, as a result of detonation of the perforating gun, it has been reported that there may be near wellbore damage resulting in a reduction in rock permeability.

Perforations through casing are also made using abrasive fluid jetting techniques whereby a tool having nozzles therein is deployed into the wellbore. An abrasive fluid is pumped through the tool to exit the nozzles, the fluid being directed against the casing. The abrasive fluid acts to cut the perforations in the casing. The abrasive fluid can be returned to surface through an annulus between the perforating tool and the casing.

It is also well known to use such abrasive jetting techniques to cut axially extending slots through the casing for establishing elongated flow paths between the formation and the wellbore. Applicant believes however that such slots may act to weaken the overall integrity of the casing, resulting in an increased risk of a localized casing failure.

Further, it is also known to use abrasive fluids exiting to cutting perforations in the casing and to penetrate the formation therebeyond for creating production channels in the formation. In U.S. Pat. No. 5,445,220 to Gurevich, a perforator having both telescoping nozzles and double jet nozzles is reciprocated within the wellbore by lifting and lowering the tool from surface, and abrasive fluid is discharged for cutting continuous perforations or slot.

There remains interest in apparatus and methods for forming openings in casing through which effective production paths may be created and for more efficiently and effectively removing near wellbore damage which encourage the flow of hydrocarbons thereto while minimizing risk to the casing structure.

SUMMARY

Generally, at least one perforating gun is fit with a movable portion of a locator for releasable coupling with a stationary portion of the locator anchored in a case wellbore. The gun forms discontinuous openings in the casing at a zone of interest. The gun is tripped out and a wash tool assembly, also fit with a movable portion of the locator to couple with the stationary portion of the locator, is run in. Non-abrasive wash fluid is jetted through the discontinuous openings for eroding the formation therebeyond while the wash tool assembly is reciprocated between uphole and downhole stops of the locator. The locator aligns the wash tool assembly with the discontinuous openings in the casing and delimits washing to about the uphole and downhole axial extent of the openings. Two or more perforating guns, assembled in one assembly or on separate tool runs, can form axially indexed openings to form a discontinuous slot for access to the formation. The non-abrasive fluids erode the formation while leaving the casing structure between openings substantially intact. The movable and stationary portions of the locator are cooperating, releasably couplable housings and mandrels. The housing contains a profiled, tubular receptacle forming one or more keyways and the mandrel is fit with one or more corresponding keys for engaging the keyways when coupled. Each receptacle keyway is profiled comprising a helical entrance and exit leg and an axially extending leg. The helical leg guides the keys to the axially extending leg, and once engaged therein, permits delimited movement, first to locate each perforating gun for forming the discontinuous slot at a zone of interest, and secondly to delimit reciprocating motion of the wash tool assembly along the slot.

In operation, the perforation gun or guns are run in, coupled at the locator and fired or detonated to form the discontinuous slot. The guns are tripped out and the wash tool assembly is run in, coupled at the locator and reciprocated along the slot while washing to erode the formation beyond the casing. Foam can be circulated or reverse circulated to remove formation debris. Two or more guns can be arranged on one tool and having two axially spaced movable portions of the locator fit thereto for staged firing, axially indexed from one another. Alternatively, two or more guns can be arranged on separate tools, each of which having a movable portion of the locator fit thereto and each spaced differentially from one another for forming axially indexed perforations. Each separate perforating gun is run in, coupled, detonated, and tripped out before the next perforation gun is run in.

In one broad aspect, a method is provided for forming slots in casing in a wellbore and for eroding the formation therebeyond for enhancing production of heavy hydrocarbons by running a perforating gun into the wellbore using a tubing string, coupling the perforating gun having a moveable portion of a locator connected thereto to a stationary portion of the locator anchored in the wellbore, downhole of a zone of interest for locating the perforating gun; and firing the perforating gun for forming a discontinuous slot of spaced-apart perforations in the casing. After forming the discontinuous slot, running a wash tool assembly into the wellbore using the tubing string, coupling the wash tool assembly having the moveable portion of the locator connected thereto to the stationary portion of the locator for locating the wash tool assembly adjacent the discontinuous slot; and reciprocating the wash tool along the discontinuous slot, while simultaneously delivering a non-abrasive fluid from the wash tool assembly through the discontinuous slot to the formation for eroding the formation therebeyond and forming debris.

Foam is flowed into the casing and returned to surface for lifting debris therein to surface. Alternatively, foam is flowed downhole through the tubing string and returned to surface through an annulus between the casing and the tubing string. In either case, the foam is flowed simultaneous with delivering the wash fluids through the discontinuous slot and can be flowed for some time thereafter.

In another broad aspect, a system for forming slots in casing in a wellbore and for eroding a formation therebeyond for forming a cavity in a zone of interest to enhance production of heavy hydrocarbons therefrom comprises one or more perforating guns having axially spaced shaped charges therein for perforating the casing and forming a discontinuous slot therethrough. A wash tool assembly has one or more nozzles directed substantially orthogonal to the casing. A locator has a stationary portion for anchoring in the wellbore downhole of the zone of interest; and a moveable portion connected to each of the one or more perforating guns and the wash tool assembly for staged and releasable coupling with the stationary portion. When the locator's moveable portion is coupled with the stationary portion, the locator positions the one or more perforating guns at the zone of interest for forming the discontinuous slot. Thereafter, the locator positions the wash tool assembly adjacent the discontinuous slot and when a non-abrasive fluid is delivered from the nozzles, the locator operatively delimits axial reciprocation of the wash tool along a length of the discontinuous slot for eroding the formation therebeyond.

BRIEF DESCRIPTION OF THE DRAWINGS

FIG. 2A illustrates first spaced-apart perforations made by a first perforating gun;

FIG. 2B illustrates first and second adjacent perforations made by first and second perforating guns indexed axially apart; and FIG. 2C illustrates obround openings formed from adjacent or overlapping first and second perforations made by first and second perforating guns indexed axially apart;

FIG. 3A illustrates first spaced-apart perforations; and FIG. 3B illustrates first and second substantially evenly spaced perforations;

FIG. 4A illustrates an uphole moveable portion engaged in the stationary portion for locating the uphole gun at a zone of interest for firing and forming the first perforations; and FIG. 4B illustrates a downhole moveable portion engaged in the same stationary portion for locating the downhole gun, axially indexed slightly from the prior location of the uphole gun, for firing and forming the second perforations indexed axially from the first perforations, FIG. 5A is a cross-sectional view of a receptacle having a locating profile formed therein, the receptacle housed in a locating housing;

FIG. 5B is a perspective view of the locating housing according to FIG. 5A; and FIG. 5C is a cross-sectional end view through the receptacle according to FIG. 5A;

FIG. 7A is a perspective view illustrating a key protruding radially outwardly therefrom and a collet arrangement for latching engagement with the receptacle of FIG. 5A; and FIG. 7B is a cross-sectional view of the movable portion according to FIG. 7A;

FIG. 7C is a detailed cross-sectional view according to FIG. 7A, a right half of the latching assembly being shown in a neutral position and a left half being shown in a run-in position; and FIG. 7D is a detailed sectional view according to FIG. 7A, a right half of the latching assembly being shown in the neutral position and a left half being shown in a lifting position for tripping out of the wellbore;

FIGS. 8A and 8B are cross-sectional views of a wash tool assembly according to an embodiment, the wash tool assembly having a locator comprising a single moveable portion of the locator connected to a downhole end of the wash tool assembly for engaging within a stationary portion of the locator anchored in the wellbore, the locator for positioning and delimiting reciprocation of the wash tool assembly along the discontinuous slot, wherein, FIG. 8A illustrates the wash tool assembly at the uphole position as shown in FIG. 1A; and FIG. 8B illustrates the wash tool assembly at the downhole position as shown in FIG. 1B;

FIG. 12A illustrates the wash tool assembly at the uphole position and FIG. 12B illustrates the wash tool assembly at the downhole position;

FIG. 13C is a perspective view of the receptacle;

FIG. 13D is an end cross-sectional view; and

FIG. 13E is a lengthwise cross-sectional view along lines A-A of FIG. 13D;

FIG. 14A illustrates the moveable receptacle having the keyway and the stationary portion having the keys poised prior to coupling;

FIG. 14B illustrates the uphole key directed by rotation to engage a helical entrance leg of the keyway;

FIG. 14C illustrates the uphole key and the downhole key engaged in circumferentially, diametrically opposed axially-extending legs of corresponding keyways, the keys at a downhole stop of each axially-extending leg, such as for positioning the perforating guns for firing or for positioning the wash tool assembly at the downhole position as shown in FIG. 1B; and FIG. 14D illustrates the uphole key and the downhole key engaged in the circumferentially, diametrically opposed axially-extending legs of their respective keyways, the moveable portion lifted to engage the keys at an uphole stop of each axially-extending leg, such as for positioning the wash tool assembly at the uphole position shown in FIG. 1A.

DETAILED DESCRIPTION

Figure 1A:
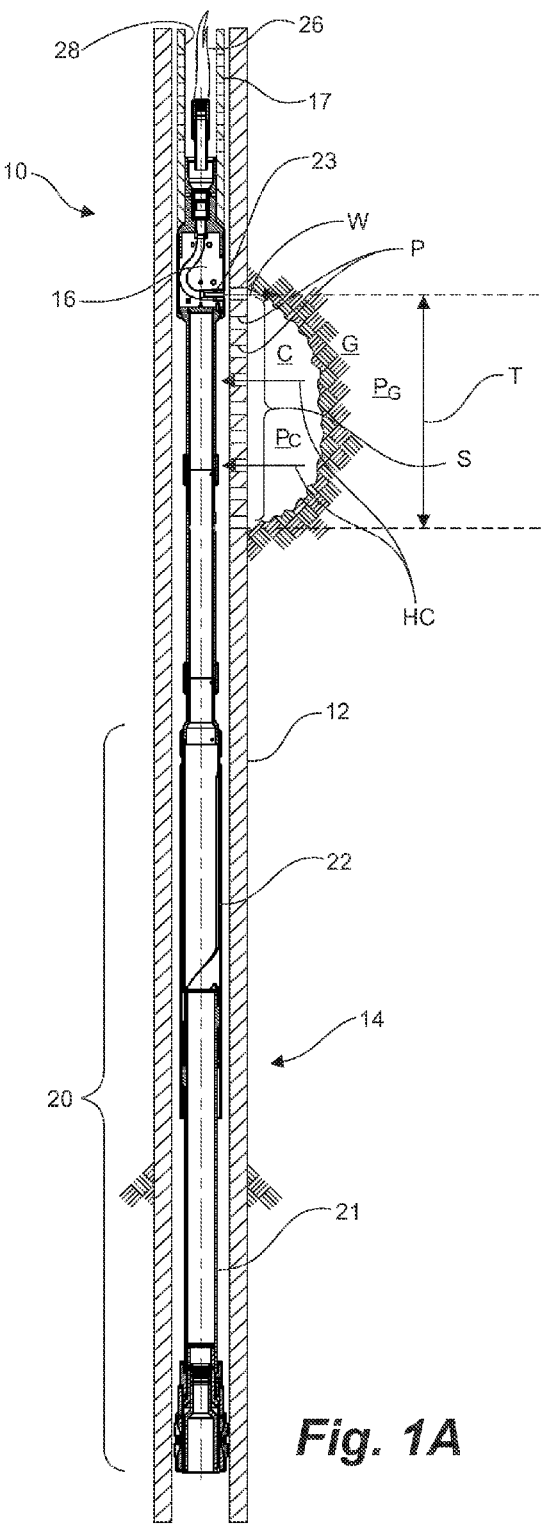
FIG. 1A is a cross-sectional view of a wellbore having a wash tool assembly anchored therein according to an embodiment disclosed herein, the wash tool assembly being positioned for reciprocation along a discontinuous slot in the cased wellbore and delivering non-abrasive fluid therethrough for forming a cavern in the formation therebeyond, the wash tool being shown at an uphole extent of travel along the slot.
Figure 1B:
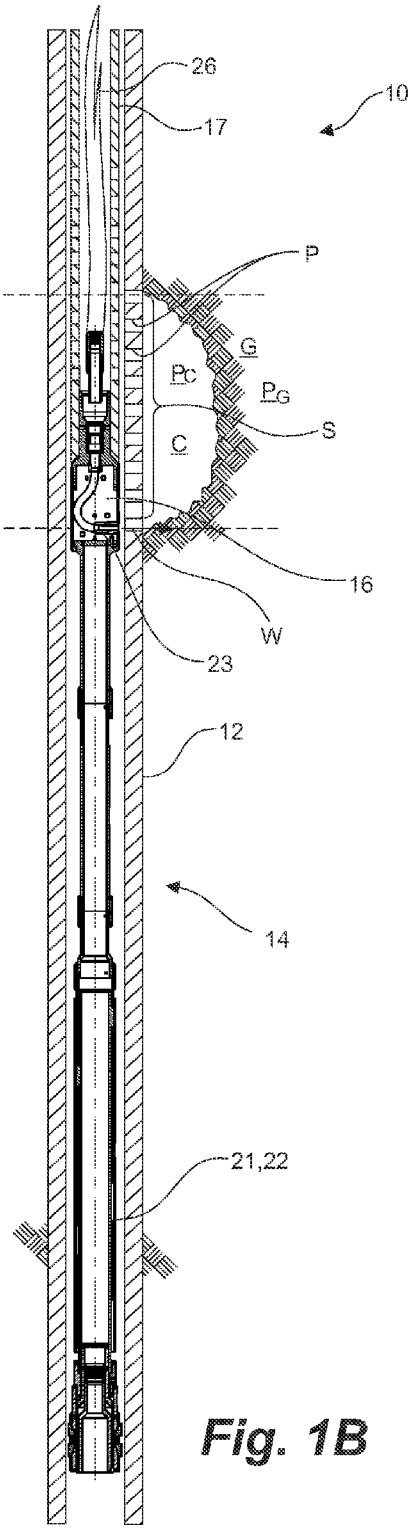
FIG. 1B is a cross-sectional view according to FIG. 1A, the wash tool assembly being shown at a downhole extent of travel along the discontinuous slot.

Having reference to FIGS. 1A and 1B, embodiments of a system 10 are illustrated for creating discrete openings or a discontinuous slot S in casing 12 of a wellbore 14 and for eroding passages or a cavern C in a hydrocarbon-bearing formation G therebeyond. The system 10 is shown for general discussion with a non-abrasive fluid jetting or wash tool assembly 16 anchored in the wellbore 14 and positioned at the slot S which has been made in the casing 12, the cavern C having been formed by washing therethrough. Non-abrasive fluids erode the formation while leaving the casing structure between openings substantially intact.

As shown in FIGS. 4A, 4B, 11A and 11B, the system 10 further comprises at least two spaced-apart perforating guns 18 in combination with the non-abrasive wash tool assembly 16. The perforating guns 18 and the wash tool assembly 16 are sequentially threaded into a downhole end of a tubing string 17 made up from jointed tubulars and are run into the casing 12. The perforating guns 18 and wash tool assembly 16 are located or positioned within the casing 12 using a locator 20 having a first stationary portion 21 anchored in the wellbore 14 downhole from a zone of interest and a second moveable portion 22 attached to the perforating guns 18 and the wash tool assembly 16. The locator's moveable portion 22 allows staged and releasable coupling from the stationary portion 21. The locator 20 acts to ensure accurate positioning of the perforating guns 18 for aligning perforations P formed therewith for forming the slot S. After tripping out the perforating guns 18, the wash tool assembly 16 is accurately positioned relative to the slot S using the locator 20 for positioning one or more nozzles 23 of the wash tool assembly 16 adjacent the slot S for delivering fluid therefrom for eroding the formation G therebeyond for forming debris and creating the passages or cavern C. While the slot S is described as discontinuous for greater casing integrity, the slot S may be continuous where the environment permits.

Figure 2C:
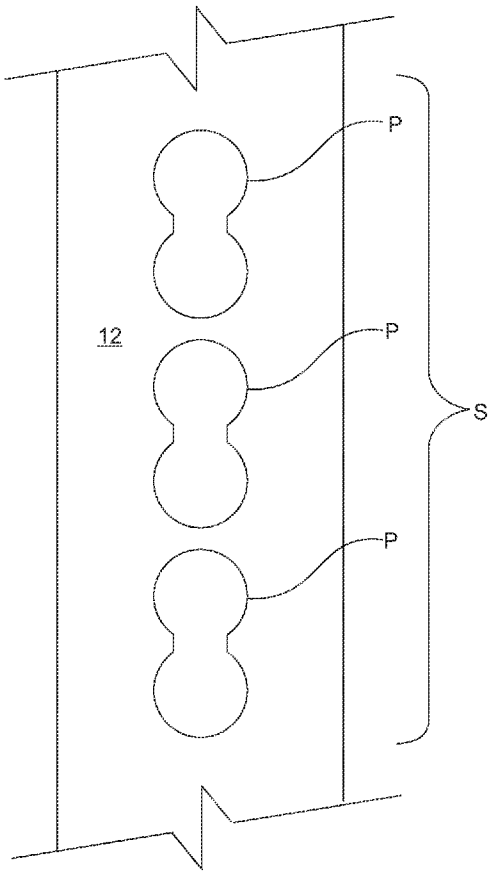
FIGS. 2A to 2C are partial side views of casing having perforations made therein with one or more perforating guns for forming the discontinuous slot, more particularly.
Figure 2B:
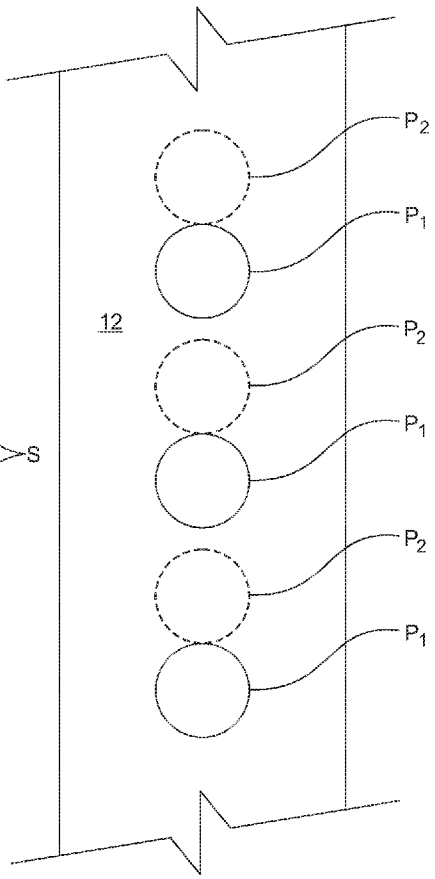
Figure 2A:
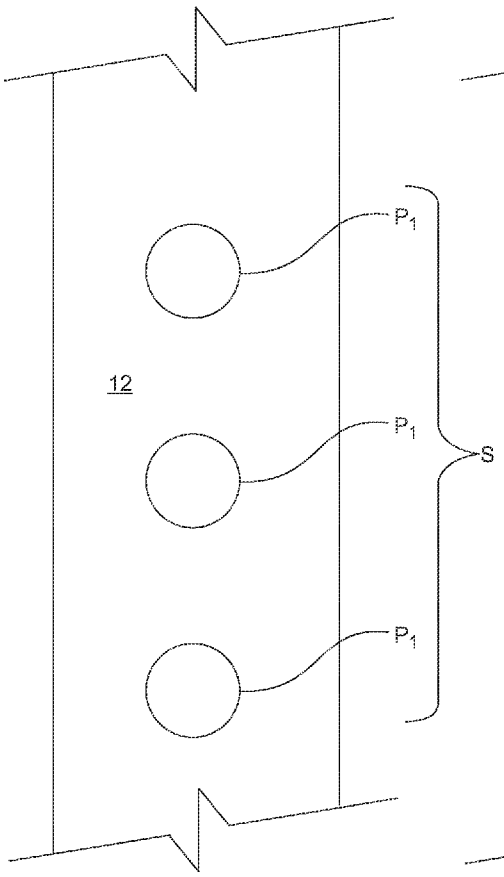
Figure 3B:
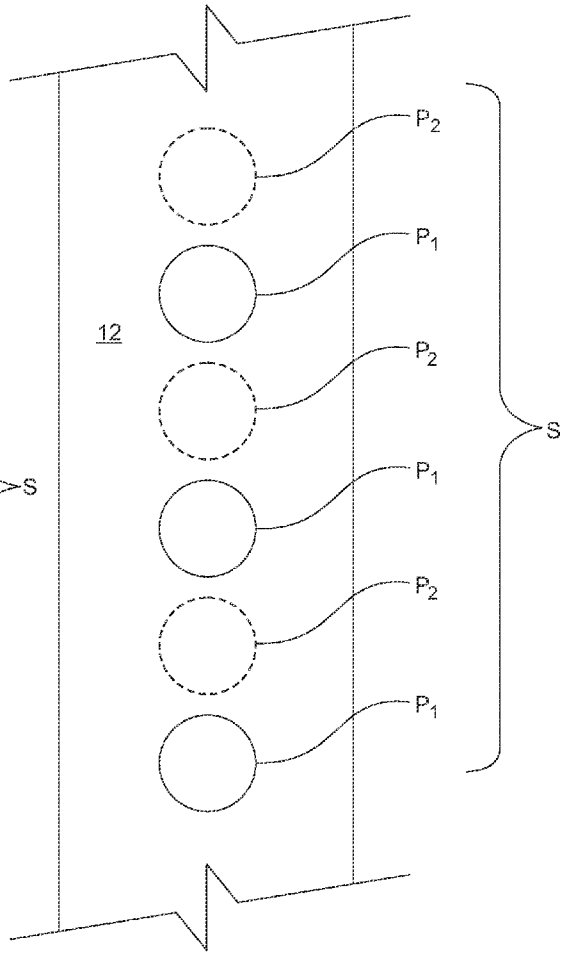
FIGS. 3A and 3B are partial side views of casing having perforations made therein with one or more perforating guns for forming the discontinuous slot, more particularly.
Figure 3A:
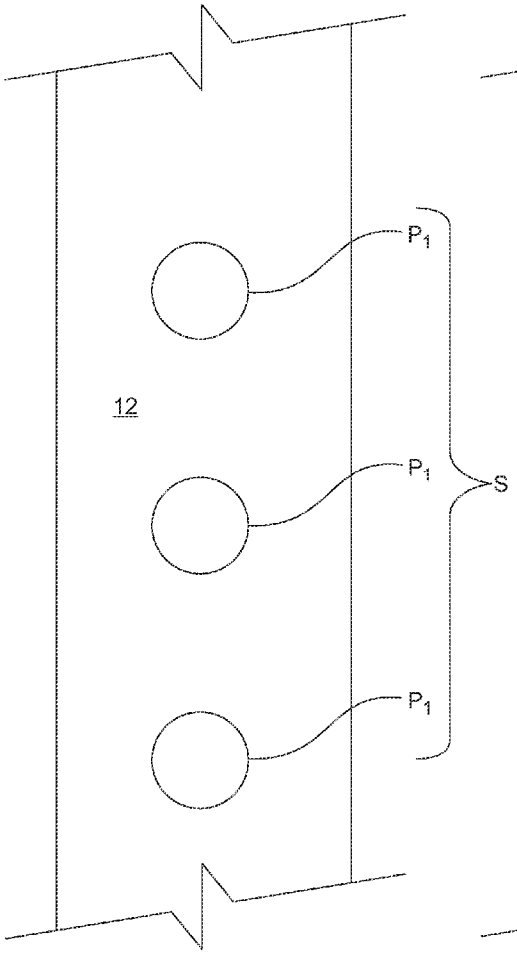

In greater detail, the two or more spaced-apart perforating guns 18 utilize shaped charges or the like (not shown) to form a series of axially aligned, adjacent yet offset or spaced-apart perforations P in the casing 12 the resulting slot S being generally discontinuous. In embodiments having one perforating gun 18, the perforations are spaced apart as shown in FIGS. 2A and 3A. In embodiments having two or more perforating guns 18, as shown in FIGS. 2A-2C, some of the offset perforations P are overlapping for forming generally obround openings P which form a "dashed" form of the discontinuous slot S. In other embodiments having two or more perforating guns 18, as shown in FIGS. 3A and 3B, the offset perforations P are evenly spaced for forming a "dotted" form of the discontinuous slot S. Applicant believes that casing material left between the obround openings or evenly spaced perforations P provides strength, or structural integrity, to the casing 12 when compared to a slot which is continuous.

Figure 4B:
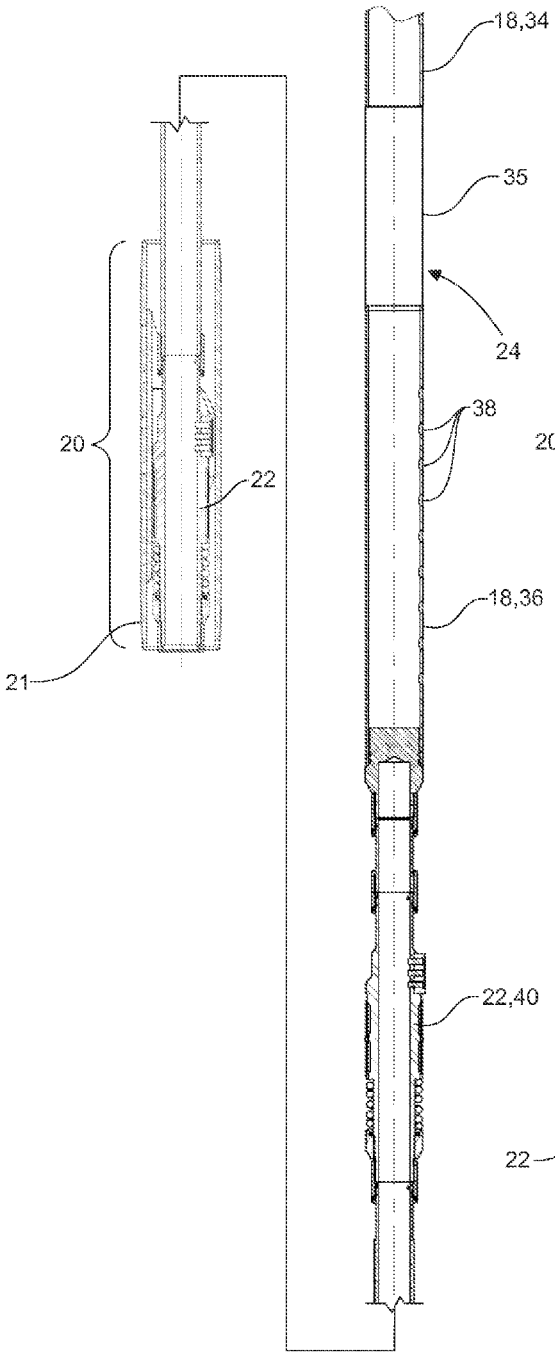
FIGS. 4A and 4B are cross-sectional views of a single perforating gun assembly according to an embodiment, the assembly having an uphole perforating gun, a downhole perforating gun and a locator comprising two spaced-apart moveable portions of the locator connected to a downhole end of the perforation guns for engaging within a stationary portion of the locator anchored in the wellbore for positioning the guns therein, more particularly.
Figure 4A:
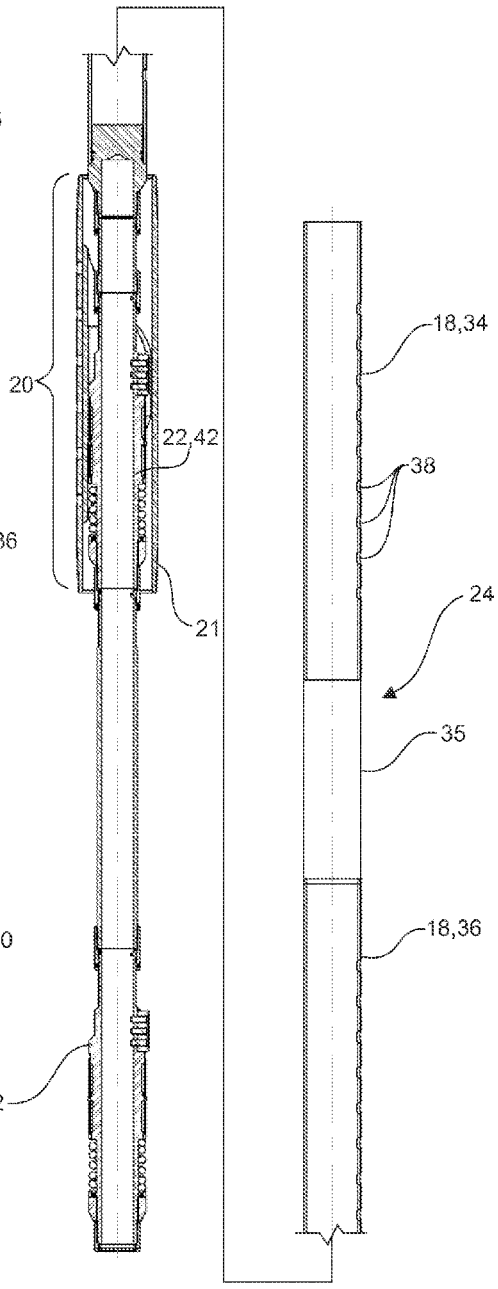

In one embodiment, as shown in FIGS. 4A and 4B, the two or more perforating guns 18 are spaced apart and assembled in a single perforating gun assembly 24 which is run into the wellbore 14 using the tubing string 17. Each of the perforating guns 18 are separately locatable in the stationary portion 21 of the locator 20 without removing the perforating gun assembly 24 from the wellbore 14 for forming the indexed perforations P.

Figure 11A:
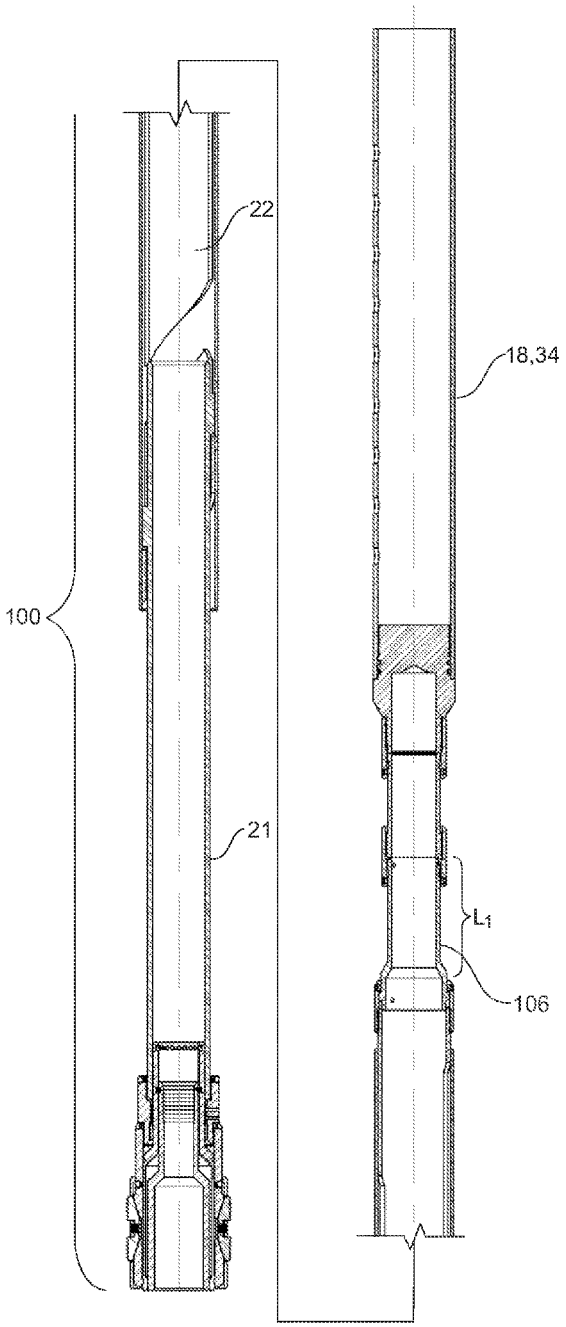
FIGS. 11A and 11B are sectional views of a first perforating gun having a locator and second perforating gun having another locater of same configuration, each perforating gun axially indexed using pup joints of different length between the gun and its respective locater, more particularly, the first perforating gun being an uphole gun having a first, long pup joint and the second perforating gun being a downhole uphole gun having a second, shorted pup joint.
Figure 11B:
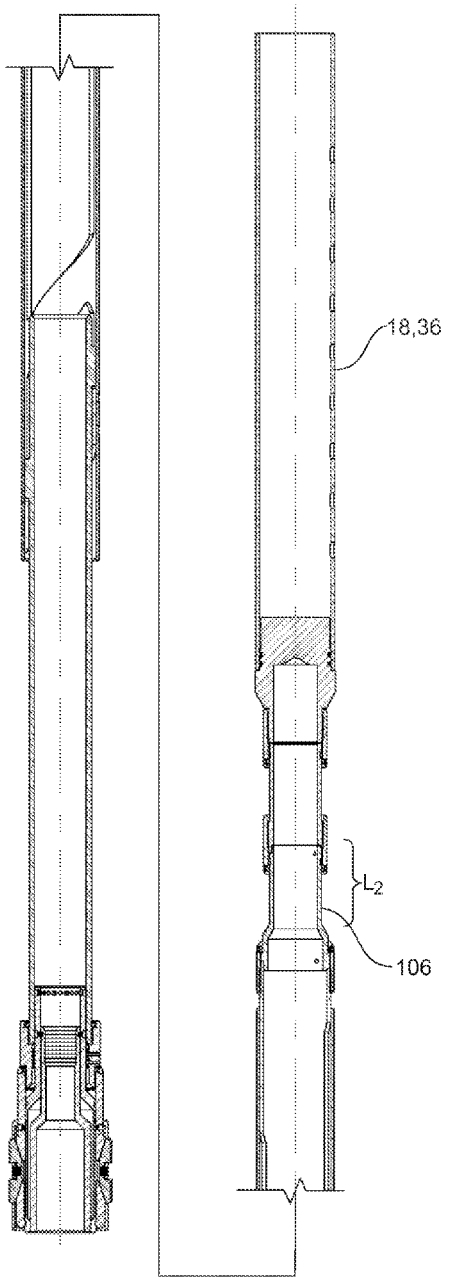

In another embodiment, as shown in FIGS. 11A and 11B, each of the two or more perforating guns 18 are separately and sequentially run into the wellbore 14 using the tubing string 17 for positioning therein using the locator 20 and forming the axially aligned perforations P. Each of the separate perforating guns 18 are assembled to have a different axial spacing so that when coupled to the anchored first portion 21 of the locator 20, the perforations P are indexed axially from one another.

Having reference again to FIGS. 2A to 3B, in either embodiment, a first perforating gun 34 is located in the wellbore 14 using the locator 20 and detonated forming first perforations P1. Thereafter, at least a second perforating gun 36 is located in the wellbore 14, indexed axially from the first perforations P1, and is detonated to form second perforations P2. The second perforations P2, together with the first perforations P1 form the discontinuous slot S.

Once the perforations P are made, the moveable portion 22 of the locator 20 and the attached two or more perforating guns 18 are uncoupled from the stationary portion 21 of the locator 20 and are tripped out of the wellbore 14 using the tubing string 17. The non-abrasive wash tool assembly 16 is then threaded to the tubing string 17 along with the moveable portion 22 of the locator 20 and is run into the wellbore 14 as shown in FIGS. 1A and 1B. The wash tool assembly 16 is located at the discontinuous slot S and aligned therewith by coupling the moveable portion 22 of the locator 20 on the wash tool assembly 16 with the stationary portion 21 of the locator 20. Coiled tubing 26 is run n downhole through a bore 28 of the tubing string 17 and is sealingly and fluidly engaged with the wash tool assembly 16. A non-abrasive fluid W, generally water, is flowed through the one or more nozzles 23 therein to the discontinuous slot S and therethrough into the formation G therebeyond. Non-abrasive fluid W avoids degradation of the casing 12, such as between the spaced perforations P.

During pumping of the non-abrasive fluid W down the coiled tubing 26, the wash tool assembly 16 is reciprocated along the extent T of the discontinuous slot S for directing the pressurized, non-abrasive fluid W from the one or more nozzles 23 therethrough into the formation G therebeyond. The non-abrasive fluid W acts to erode at least unconsolidated sand and materials from the formation G creating the cavern C therein. Once created, a pressure $P_C$ in the cavern C is generally lower than a pressure $P_G$ in the formation G. The pressure differential between the cavern pressure $P_C$ and the formation pressure $P_G$ encourages hydrocarbons HO therein to flow from the formation G to the cavern C and to the wellbore 14 through the discontinuous slot S in the casing 12.

In an embodiment, as shown in FIGS. 4A to 10B, the system 10 comprises the single perforating gun assembly 24 having the two or more perforating guns 18, a wash tool assembly 16 and the locator 20. The locator 20, positions each of the two or more perforating guns 18 sequentially at a desired position in the wellbore 14 as described in greater detail below. The locator 20 generally comprises a male and female coupling. Whether the male or female portion is moveable or stationary is not deemed critical. As shown in this embodiment, the locator 20 comprises the first stationary portion 21 which is a locator housing 30 having a locating receptacle 32 formed therein for anchoring in the wellbore 14 downhole from the zone of interest. The second moveable portion 22 is connected to the perforating gun assembly 24.

In order to properly align the perforating gun assembly 24 during creation of the discontinuous slot S and thereafter for locating the wash tool assembly 16 at the discontinuous slot S for washing therethrough, the locator housing 30 is first deployed and anchored into the casing 12 of the wellbore 14 prior to running in the perforating gun assembly 24 and the wash tool assembly 16. The locating receptacle 32 therein operatively engages or couples in the second moveable portion 22 of the perforating gun and the wash tool assemblies 24,16 for aligning axially within the wellbore 14. The locator housing 30 and receptacle 32 are typically housed or supported in a bridge plug or packer which is run into the wellbore 14 and anchored to the casing 12 therein prior to the slot perforating and cavern-forming operations.

In greater detail, the two or more perforating guns 18 in the single perforating gun assembly 24 comprise upper and lower, axially-spaced perforating guns 34,36, each perforating gun 34,36 having sets of axially-spaced charges 38 therealong. The perforating guns 34,36 are spaced apart from each other, such as by a pup joint 35. The second moveable portion 22 of the locator 20 comprises upper and lower, spaced-apart, gun-locating latch assemblies 40,42 which are operatively connected to the perforating gun assembly 24 below the lower perforating gun 36.

Figure 7B:
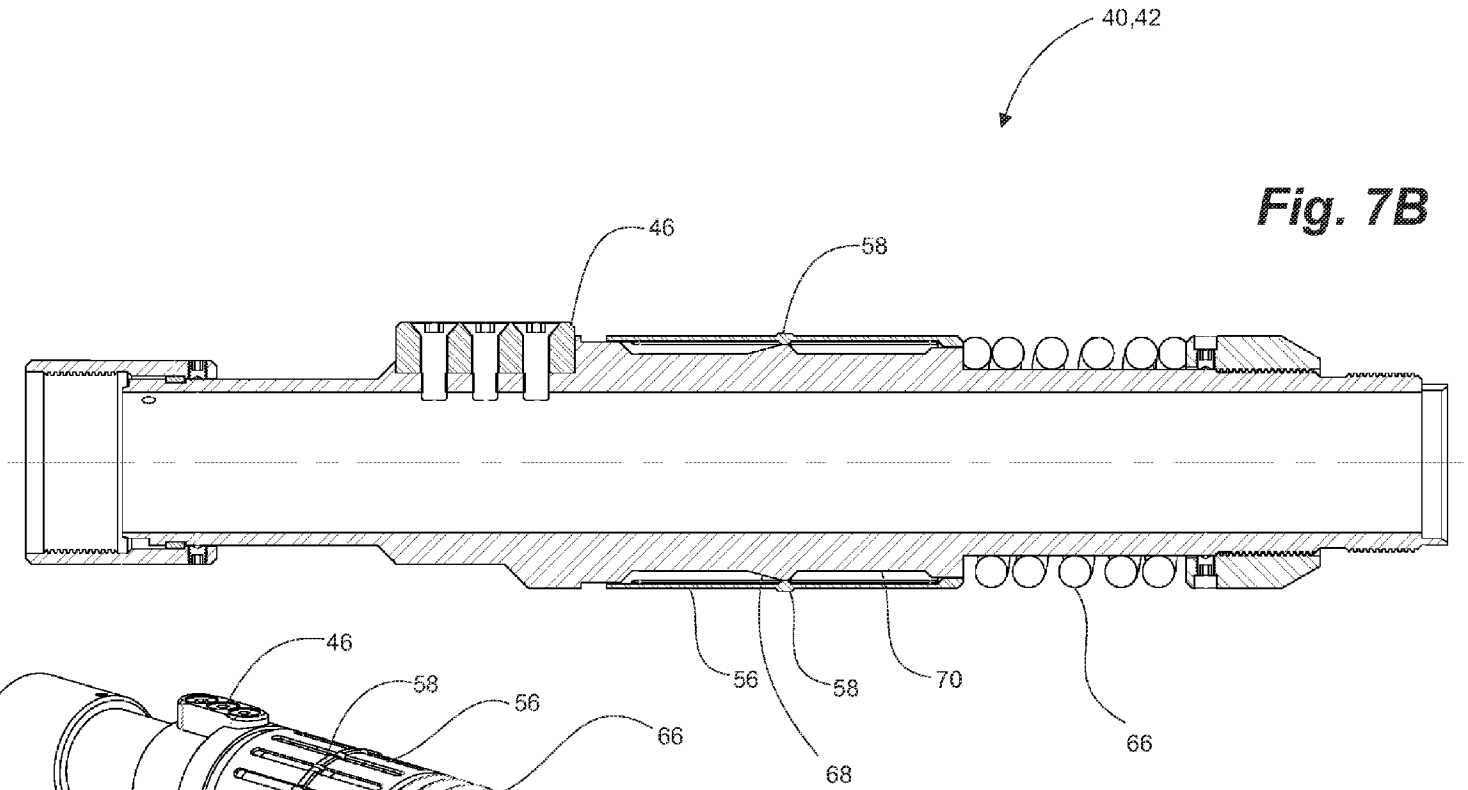
FIGS. 7A and 7B are views of each of two moveable portions of the locator according to FIG. 4A for the one or more perforating guns, more particularly
Figure 7A:
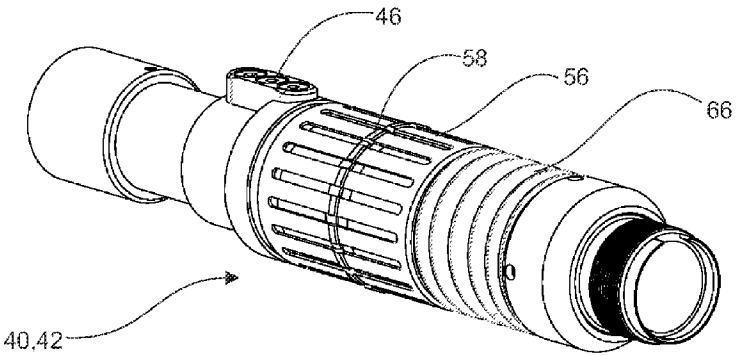
Figure 8A:
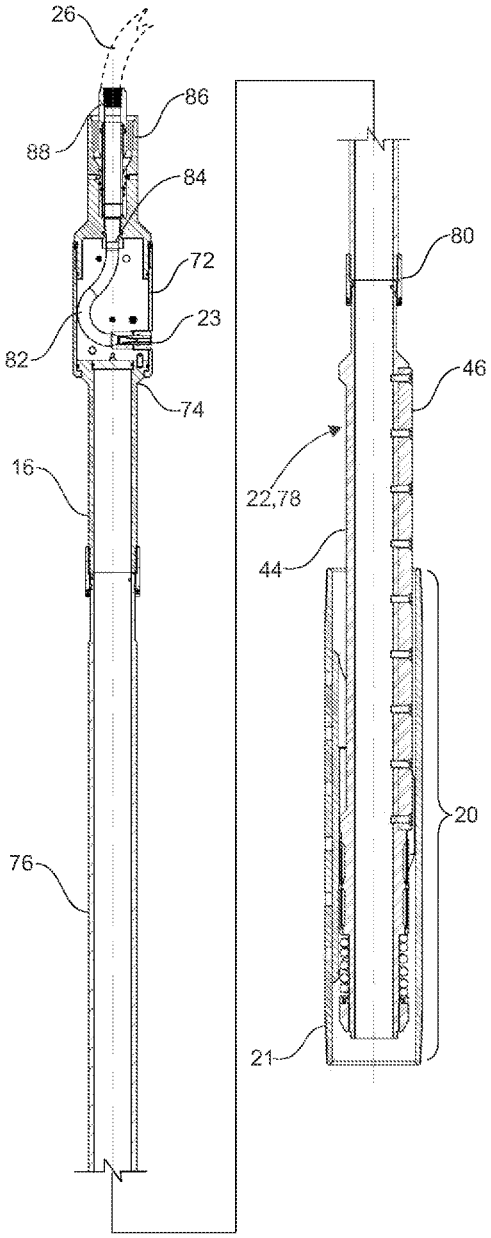
Figure 8B:
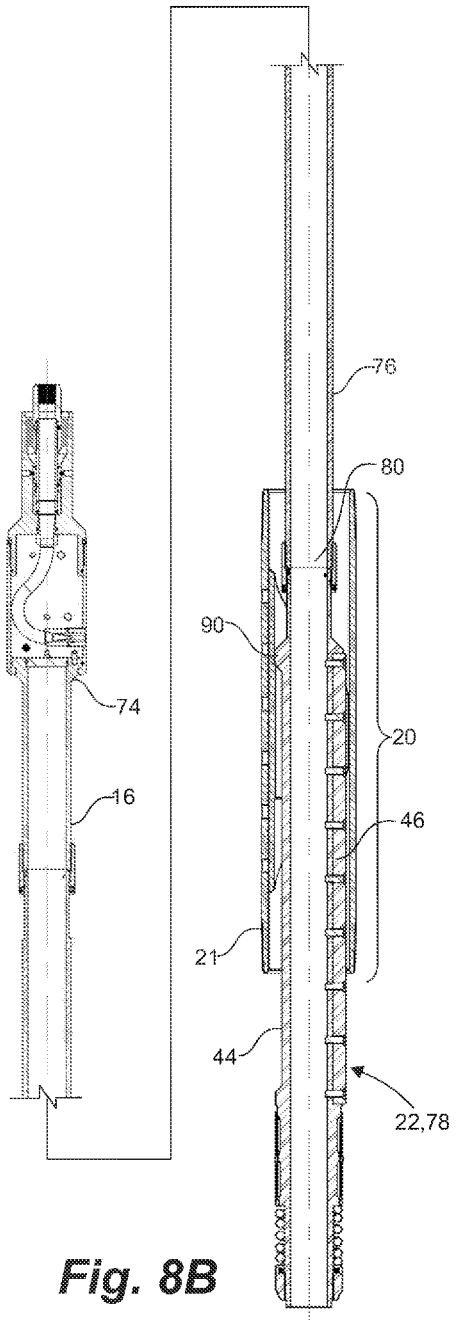
Figure 9B:
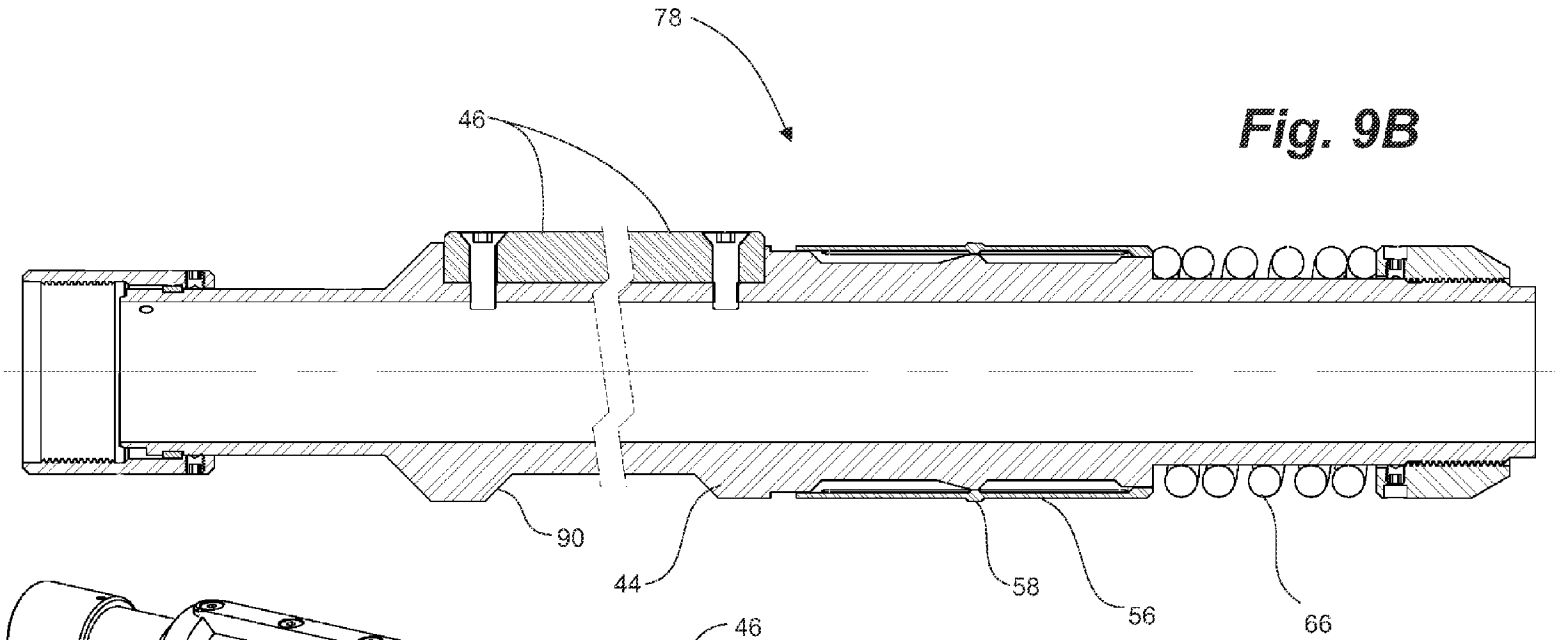
FIG. 9B is a cross-sectional view of the locator according to FIG. 9A.
Figure 9A:
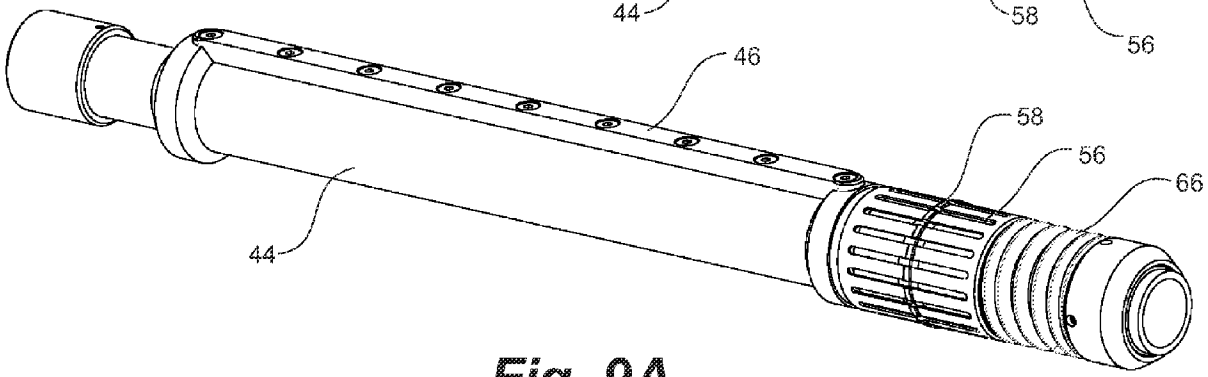
FIG. 9A is a perspective view of the moveable portion of the locator according to FIG. 8A, the moveable portion having an elongate key protruding radially outwardly therefrom, a stop and a collet arrangement for latching engagement in the receptacle of FIG. 5A.

Best seen in FIGS. 7A, 8A and 8B, each of the upper and lower latch assemblies 40,42 further comprise a tubular latch body 44 having a key 46 protruding therefrom which cooperates with and is engageable within a keyway 48 in the receptacle 32 in the locator housing 30. The upper and lower latch assemblies 40,42 are spaced apart using a spacer joint assembly 50.

Figure 5A:
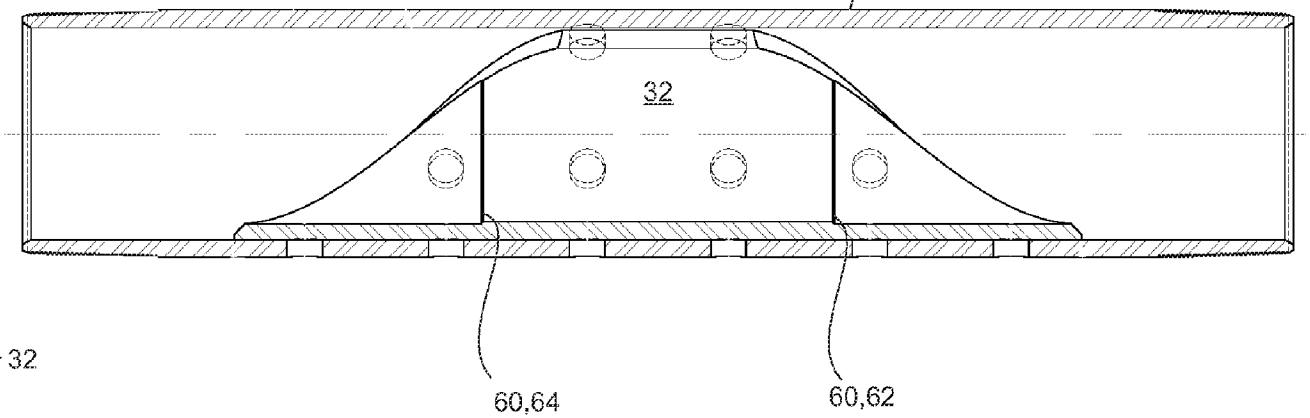
FIG. 5A through 5C are views of an embodiment of the stationary portion of the locator according to FIG. 4A, and more particularly.
Figure 5B:
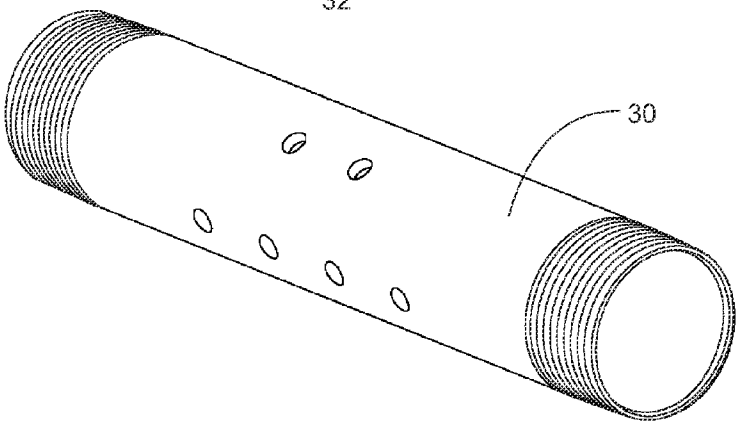
Figure 5C:
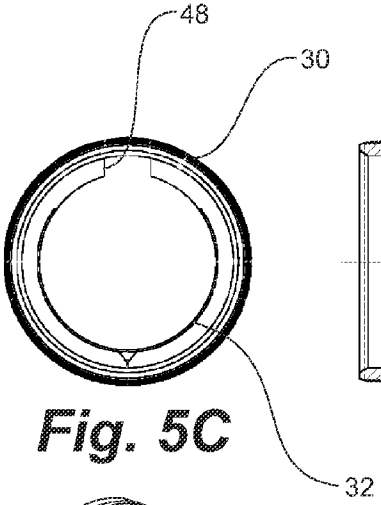
Figure 6:
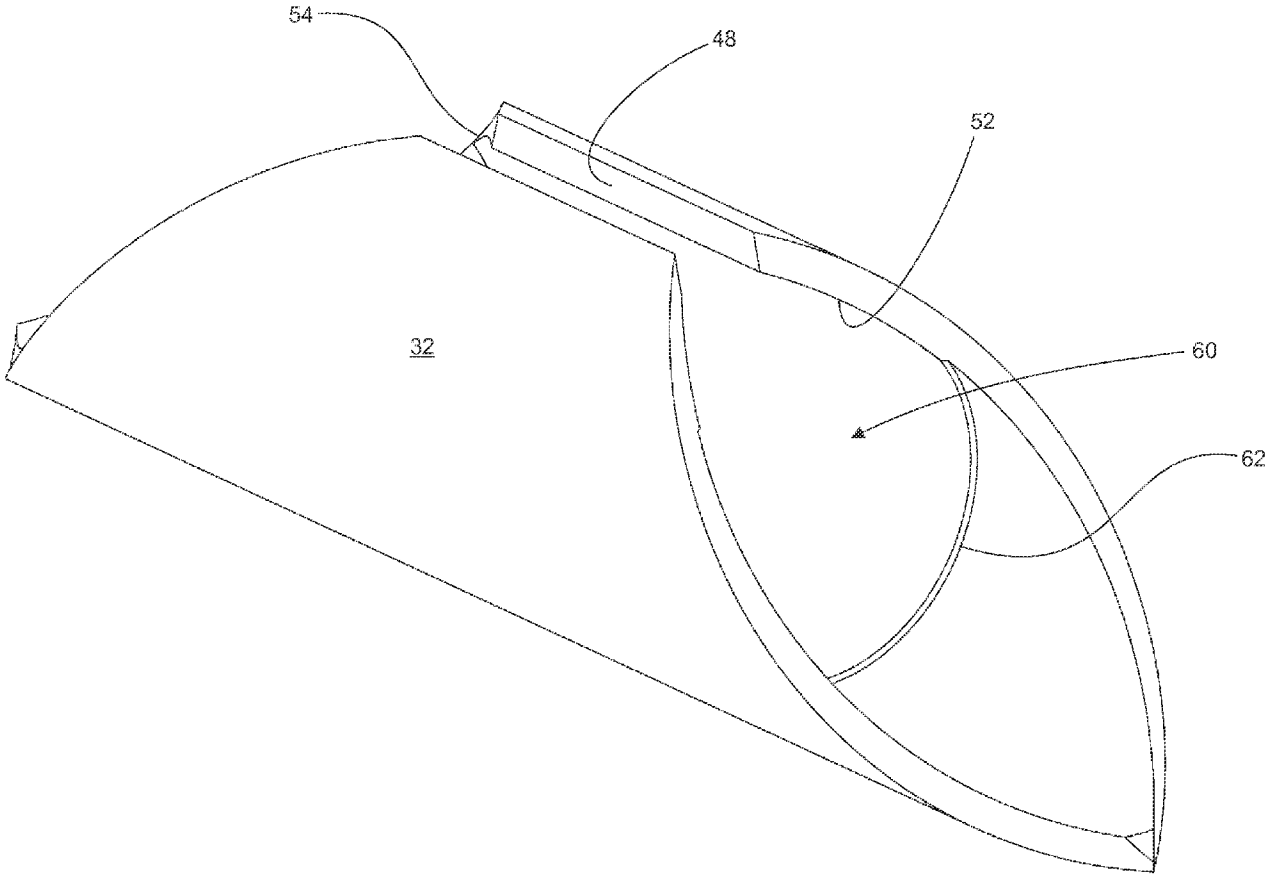
FIG. 6 is a perspective view of the receptacle of FIG. 5A, illustrating a helical entrance, a helical exit and a keyway formed therein, the locating housing having been removed for clarity.

As shown in FIGS. 5A and 6, the keyway 48 has a helical entrance 52 and a helical exit 54 to aid in guiding the latch body 44 into the receptacle 32, and the cooperating key 46 into the keyway 48, during travel moving from uphole of the latching receptacle 32 and travel moving from downhole of the latching receptacle 32.

Further, as shown in FIGS. 5A, 7A and 7B, each latch assembly 40,42 has a latch collet 56 for permitting delimited movement and release from the locator housing 30. The collet 56 has a collet tab 58 that engages a locating profile 60 in the receptacle 32. The locating profile 60 comprises two shoulders, an uphole shoulder 62 to enable each latch assembly 40,42 to control downhole entry into the receptacle 32 (FIG. 7C) and a downhole shoulder 64 control uphole release from the receptacle 32 (FIG. 7D). The collet 56 is biased to an uphole, normal position, such as by biasing spring 66. When pulling out of hole, the collet tab 58 engages the downhole shoulder 64 and enables biased release of the latch assembly 40,42.

Figure 7C:
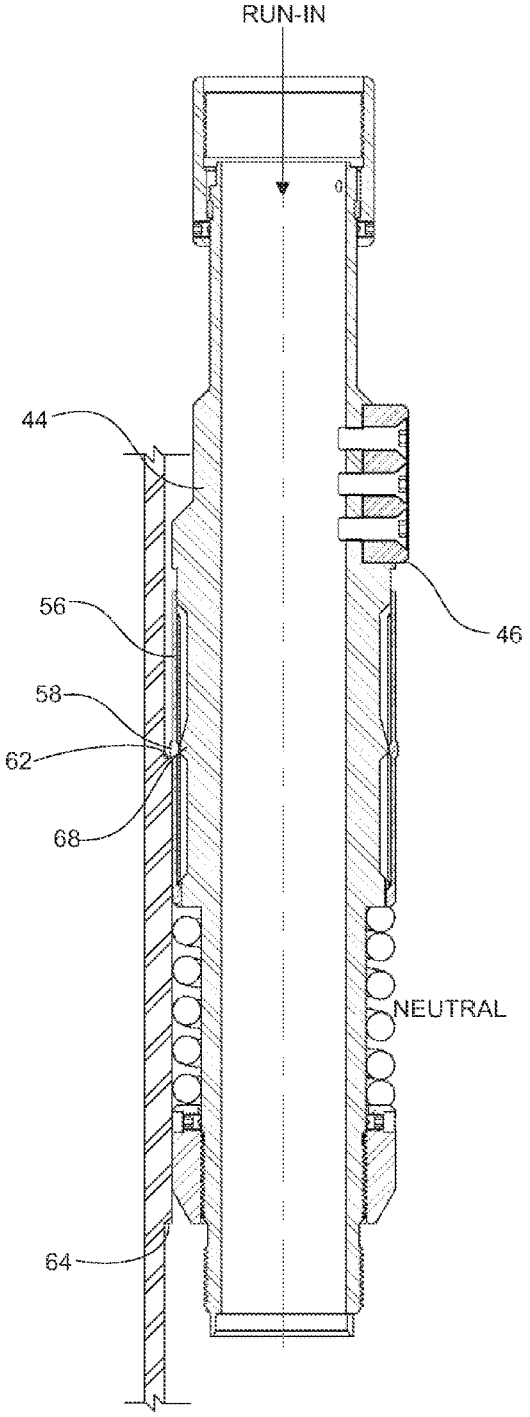
FIGS. 7C and 7D are views of one of the two moveable portions of the locator according to FIG. 4A and shown while running in to couple and tripping out to uncouple, more particularly
Figure 7D:
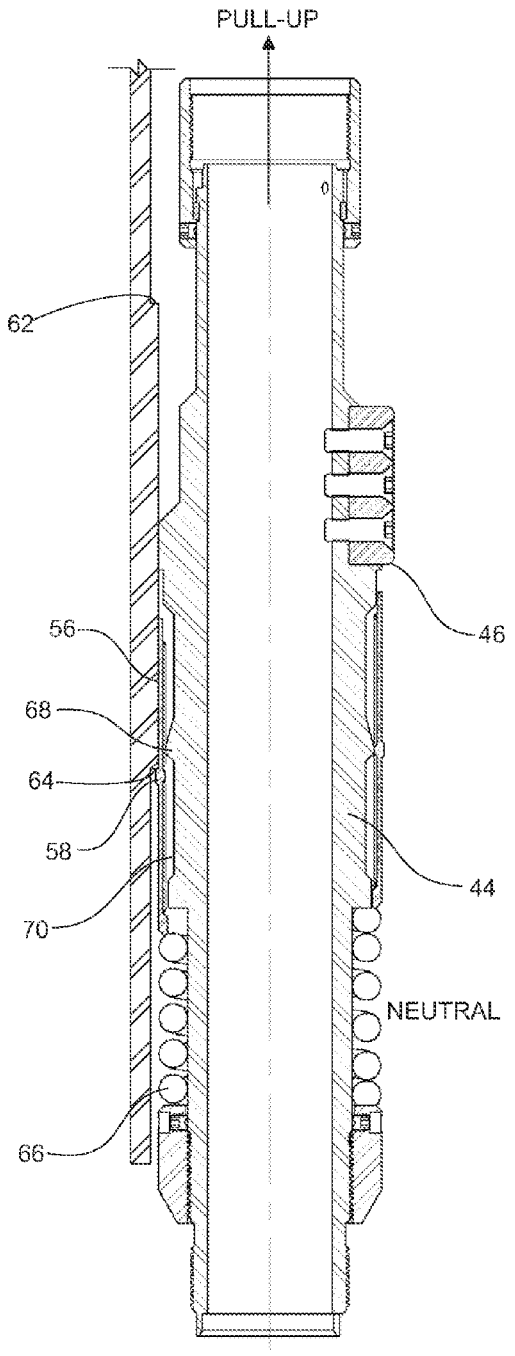

As shown in FIGS. 4A and 7C, following anchoring of the locator housing 30 and receptacle 32 in the wellbore 14 as previously described, when the perforating gun assembly 24 is run-in using the tubing string 17, the key 46 on the lower latch assembly 42 aligns with the keyway 48 in the receptacle 32 actuating the collet 56 to engage the locating profile 60 for aligning the lower perforating gun 36 relative to the casing 12. The collet tab 58 engages the uphole locating shoulder 62, stopping movement of the lower latch assembly 42, and shifting the collet 56 uphole, offsetting the collet tab 58 uphole from a support 68, permitting collet flexure at about the collet tab 58. Sufficient force is applied to the tubing string 17 so as to flex the collet 56 and collet tab 58 radially inward, flexing the collet 56 to permit the collet tab 58 of the lower latch assembly 42 to pass by the uphole locating shoulder 62 in the receptacle 32.

The perforating gun assembly 24 is further lowered using the tubing string 17 and the collet 56 passes by the lower locating shoulder 64 in the receptacle 32. The perforating gun assembly 24 continues downhole until the collet tab 58 of the upper perforating gun 34 engages the uphole locating shoulder 62. In this case, the upper perforating gun assembly 34 is not forced past the uphole locating shoulder 62 and is thus positioned for detonating the charges 38 therein and enabling creation of the first set of axially aligned, substantially circular perforations P1.

Thereafter, as shown in FIG. 7D, the perforating gun assembly 24 is pulled uphole using the tubing string 17 until the key 46 in the lower latch assembly 42 engages in the receptacle's keyway 48 and the collet tab 58 of the lower perforating gun 36 engages the downhole locating shoulder 64 of the locating profile 60. The collet 56 is forced downhole, shifting the collet 56 against the biasing spring 66. The collet 56 shifts sufficiently to shift the collet tab 58 downhole of the support 68, permitting the collet 56 to flex, releasing the upper perforating gun 34.

In more detail, sufficient uphole pulling force is applied to the tubing string 17 to compress the biasing spring 66 and permit the collet tab 58 to move off the support 68 and enable the collet 56 to flex into profiles 70 in the latch body 44 for releasing the upper latch assembly 40 therefrom and permitting the upper latch assembly 40 to move uphole of the receptacle 32.

The perforating gun assembly 24 is pulled up until the collet tab 58 is released over the downhole locator shoulder 64. Once the collet tab 58 is uphole of the uphole shoulder 62, the biasing spring 66 resets the collet 56 with the collet tab 58 over the support 68, keeping the collet tab 68 radially outwards and engagable with the uphole shoulder 62, preventing downhole movement without applying the additional shifting forces.

The lower perforating gun assembly 36 is now located axially offset from the first set of perforations P1 for creating a second set of axially aligned substantially circular perforations P2. As previously described, as shown in FIGS. 2A to 2C, each of the second perforations P2 can meet or overlap a first perforation P1 for creating elongate obround perforations. The obround perforations P are axially spaced from one another for forming the discontinuous slot S. Alternatively, as shown in FIGS. 3A and 3B, the first and second perforations P1, P2 can be evenly spaced for forming the discontinuous slot S. Thereafter, the perforating gun assembly 24 is pulled uphole using the tubing string 17 to release the lower latch assembly 42 from the latch housing 30 and receptacle 32 for tripping out of the wellbore 14.

In an embodiment, the perforations P1, P2 have a diameter of about 1 inch and the obround perforations P or the evenly spaced first and second perforations P1, P2, are spaced from one another by about ⅜" to about 1/16".

As shown in FIGS. 1A, 1B, 9A and 9B, the non-abrasive wash tool assembly 16 comprises a wash tool housing 72 at an uphole end 74, spaced from a wash tool latching assembly 78 at a lower end 80 by a tubular body 76. The wash tool housing 72 defines a falciform fluid passage 82 therein which receives the non-abrasive fluid W at an uphole inlet end 84 to which the coiled tubing 26 is fluidly and sealingly connected. The fluid passage 82 terminates in the one or more nozzles 23 which direct the non-abrasive fluid W therefrom, generally orthogonal to the wellbore casing 12 and through the discontinuous slot S. The passage's uphole inlet end 84 has an adapter 86 into which the coiled tubing 26 can be stabbed for fluidly connecting with the passage 82, after the wash tool assembly 16 has been run into the wellbore 14 using the jointed tubing string 17. A seal 88 is operatively engaged between to the adapter 86 and the coiled tubing 26 to ensure the coiled tubing 26 is sealed within the adapter 86 to permit the non-abrasive fluids W to be delivered therethrough at sufficient rates and pressures to erode the formation G beyond the discontinuous slot S.

The wash tool latching assembly 78, like the upper and lower perforating gun latch assemblies 40,42, has the latch body 44 and key 46 protruding therefrom for engaging with and coupling in the keyway 48 of the receptacle 32 anchored in the wellbore 14.

Because the wash tool assembly 16 is reciprocated axially along the discontinuous slot S, the key 46 on the wash tool latching assembly 78 is sufficiently elongate to permit substantially continuous engagement of the key 46 within the keyway 48 throughout the extent of travel T of the wash tool assembly 14. The elongate key 46 maintains the alignment of the one or more nozzles 23 in the housing 72 with the discontinuous slot S.

Figure 10B:
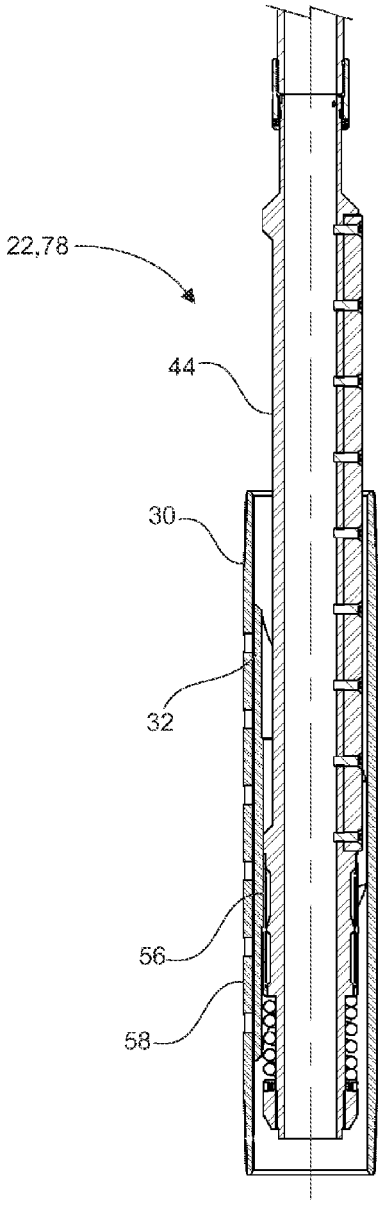
FIGS. 10A and 10B are cross-sectional views according to FIG. 8A, the movable portion of the wash tool assembly locator being shown in an uphole and a downhole position respectively.
Figure 10A:
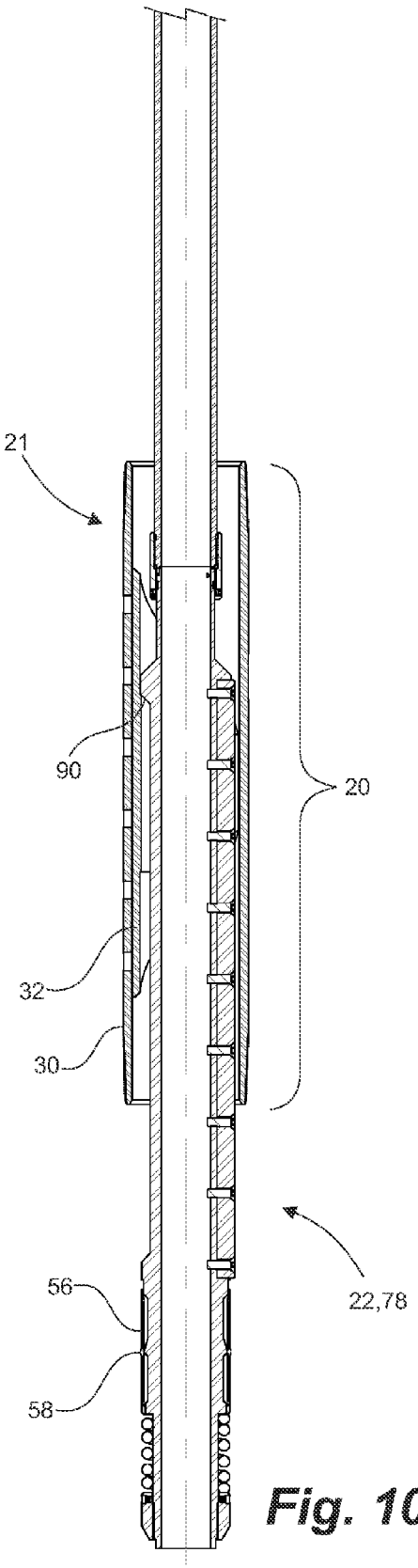

Having reference to FIGS. 10A and 10B, as with the perforating gun assembly 24, the collet 56 and collet tab 58 on the wash tool latching assembly 78 enable the wash tool assembly 16 to be run into the wellbore 14 and positioned at the discontinuous slot S. The collet tab 58 engages the uphole shoulder 62, delimiting axial movement the wash tool latch assembly 78, and shifting the collet 56 uphole, offsetting the collet tab 58 uphole from the support 68, permitting collet flexure at about the collet tab 58. Sufficient downhole force is applied to the tubing string 17 so as to flex the collet 56 and collet tab 58 radially inward, to permit the collet tab 58 to pass by the uphole locating shoulder 62 in the receptacle 32. An uphole stop 90 on the wash tool latching assembly 78 engages the uphole shoulder 62 of the locating profile 60 for delimiting the downhole axial travel T of the wash tool assembly 16 and the one or more nozzles 23 relative to the discontinuous slot S.

The wash tool assembly 16 is then reciprocated within the receptacle 32 by lifting and lowering the wash tool assembly 16 using the tubing string 17. The collet tab 58 on the wash tool latching assembly 78 engages the locating profile's downhole shoulder 64 for delimiting the uphole axial travel of the wash tool assembly 16.

As with the perforating gun assembly 24, when the wash tool assembly 16 is pulled uphole to trip out of wellbore 14, the collet tab 58 of the wash tool latching assembly 78 engages the downhole locator shoulder 64. The collet 56 is forced downhole, shifting the collet 56 against the spring 66. The collet 56 shifts sufficiently to shift the collet tab 58 downhole of the support 68, permitting the collet 56 to flex, releasing the wash tool assembly 16.

In more detail, sufficient pulling force is applied to the tubing string 17 to compress the biasing spring 66 and permit the collet tab 58 to move off the support 68 and enable the collet 58 to flex into the profiles 70 in the latch body 44 for releasing the latch assembly 78 therefrom and permitting the latch assembly 78 to move uphole of the receptacle 32. The wash tool assembly 16 is pulled uphole until the collet tab 58 is released over the uphole locating shoulder 62. The spring 66 resets the collet 56 with the collet tab 58 over the support 68, keeping the collet tab 58 radially outwards and engaged with the uphole locating shoulder 62, preventing downhole movement without applying the additional shifting forces.

In use, the wash tool assembly 16 is run into the wellbore 14 using the jointed tubing string 17 after removal of the perforating gun assembly 24. The latch housing's key 46 engages and couples within the keyway 38 in the receptacle 32 for aligning the one or more nozzles 23 at the discontinuous slot S. Sufficient downhole force is applied on the tubing string 17 to flex the collet 56 in the wash tool latch assembly 78 and the collet 56 is run through the receptacle 32 until the uphole stop 90 engages with uphole shoulder 62 in the receptacle 32, delimiting further downhole travel. The uphole stop 90 and uphole shoulder 62 define a lower limit of travel for the wash tool assembly 16.

Thereafter, the coiled tubing 26 is run into the bore 28 of the tubing string 17 above the wash tool assembly 16 and is stabbed into the adapter 86 at the uphole inlet end 84 of the fluid passage 82. Non-abrasive fluid W, such as water, is flowed through the coiled tubing 26 while, at the same time, the wash tool assembly 16 is lifted until a lower stop 92 and the collet 56 engage within the receptacle 32, defining an upper limit of travel of the wash tool assembly 16. The key 46 remains engaged in the keyway 48 in the receptacle 32 throughout, ensuring proper polar alignment along the entirety of the extent of axial travel T of the wash tool assembly 16. The process of lifting and lowering the wash tool assembly 16 using the tubing string 17 while simultaneously delivering non-abrasive fluid W through the one or more nozzles 23 is repeated until sufficient formation materials G are eroded behind the discontinuous slot S to form a cavern 86, having a desired size and/or effect on hydrocarbon HO mobility thereto.

In embodiments, as shown in the wellbore context in FIGS. 1A and 1B, to aid in removal of debris created by the erosion of the formation G, foam F is delivered to an annulus 94 between the casing 12 and the tubing string 17, simultaneous with flowing the non-abrasive fluid W through the coiled tubing 26. The tubing string 17 has openings 96, formed therein through which the foam F and debris can enter the tubing string 17 to lift the debris to surface therethrough. Alternatively, the foam is pumped down the tubing string 17, through openings 96, and is returned up the annulus 94.

In another embodiment, as shown in FIGS. 1A, 1B, and FIGS. 11 to 14E, a simplified locator 100 again comprises the first stationary portion 21 and the second moveable portion 22. Unlike the earlier locator 30, the simplified locator 100 does not utilize a locating profile 60. Locator 100 is readily actuated by rotation of the jointed tubing string 15 to engage one or more keys 46 with the keyway 48.

Generally, the locator 100 comprises the receptacle 32 having the keyway 48 formed therein. In this embodiment the receptacle 32, housed in the locator housing 30, is connected to a downhole end 102 of each of the two or more perforating guns 18 and the wash tool assembly 16. The housed receptacle 32 forms the moveable second portion of the locator 100. The one or more keys 46 are formed on an outer surface 104 of the latch body 44. The latch body 44 and the one or more keys 46, forming the first stationary portion 21, is anchored in the wellbore 14 downhole from the zone of interest prior to running in the perforating guns 18 and the wash tool assembly 16.

In this embodiment, the two or more perforating guns 18 comprise individual upper and lower perforating guns 34,36 which are separately and sequentially run into the wellbore 14 using the tubing string 17. Each of the perforating guns 34,36 are connected to the locator housing 30 of the moveable portion 22 by a length of jointed tubing or pup joint 106. In the case of the upper perforating gun 34, the first pup joint 106 has a length $L_1$ that is longer than the length $L_2$ of the second pup joint 106 for the lower perforating gun 36. The difference in the lengths $L_1$, $L_2$ of the first and second pup joints 106, given otherwise like dimensions of their respective locators 100, determines the axial offset of the first perforations P1 from the second perforations P2 for forming the discontinuous slot S.

Figure 12A:
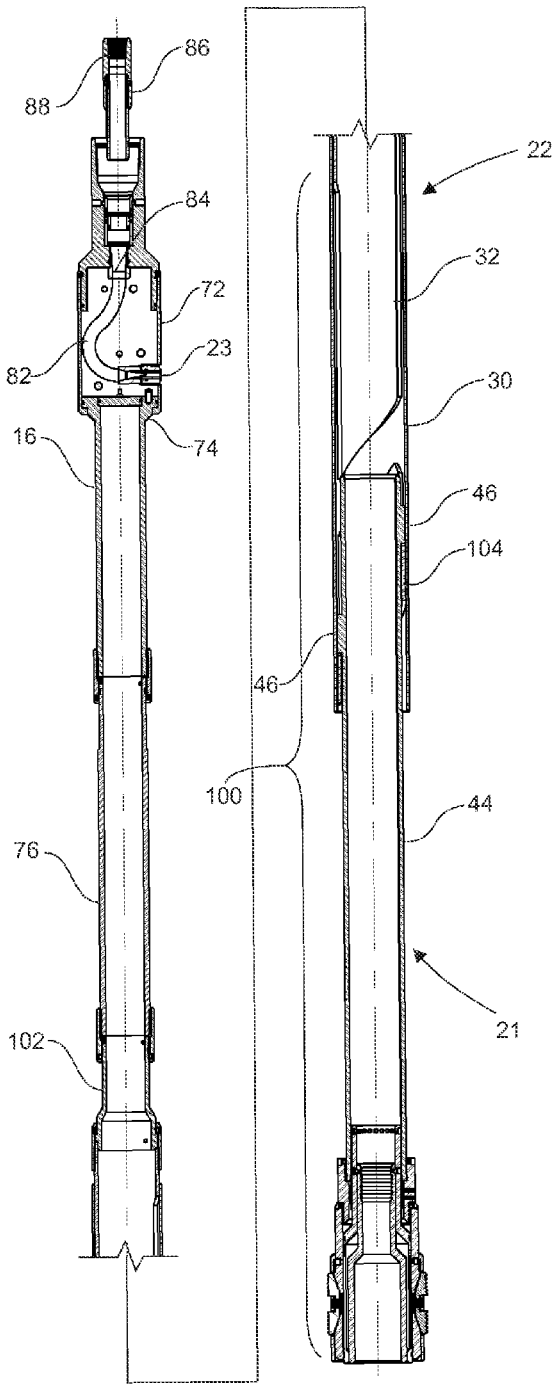
FIGS. 12A and 12B are sectional views of a wash tool assembly according to another embodiment, the wash tool assembly having a locator according to FIGS. 11A and 11B and comprising a moveable portion of the locator connected to a downhole end of the wash tool assembly for engaging within a stationary portion of the locator anchored in the wellbore for positioning and delimited reciprocating of the wash tool assembly along the discontinuous slot, more particularly.
Figure 12B:
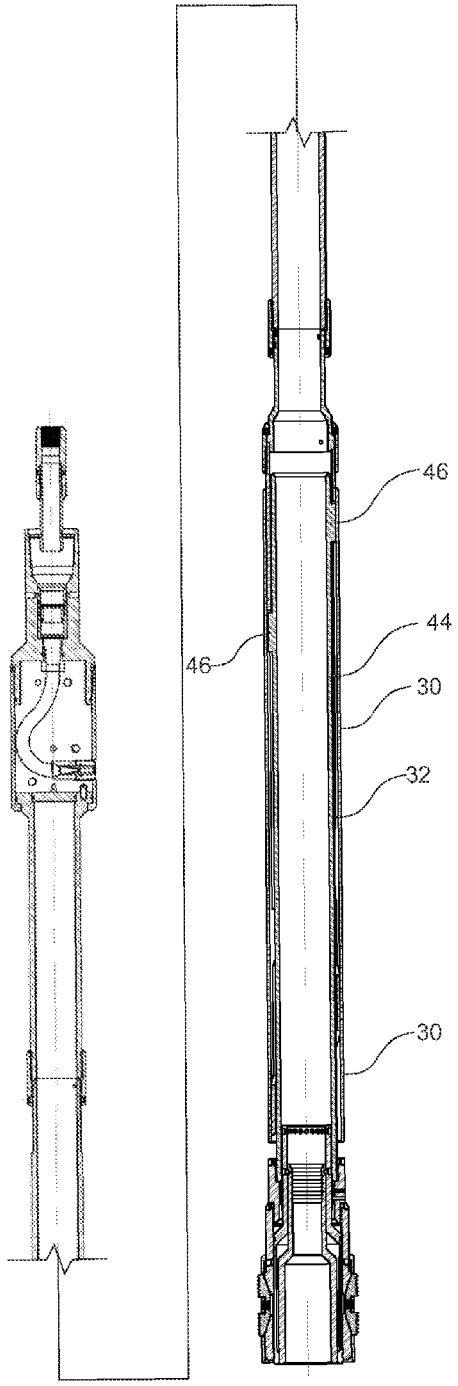
Figure 13B:
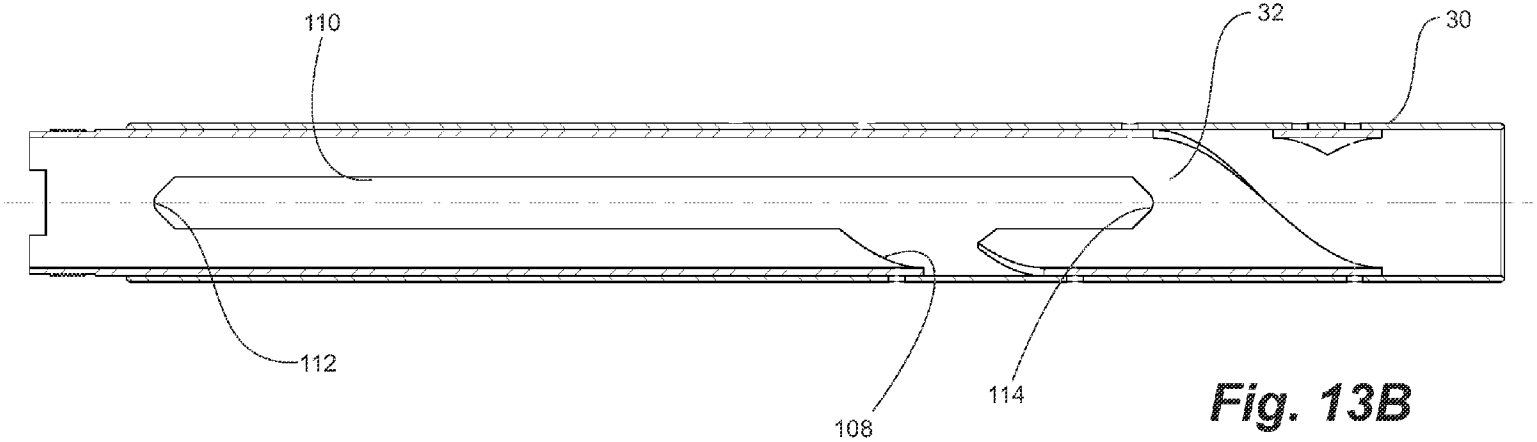
FIG. 13B is a cross-section view according to FIG. 13A.
Figure 13A:
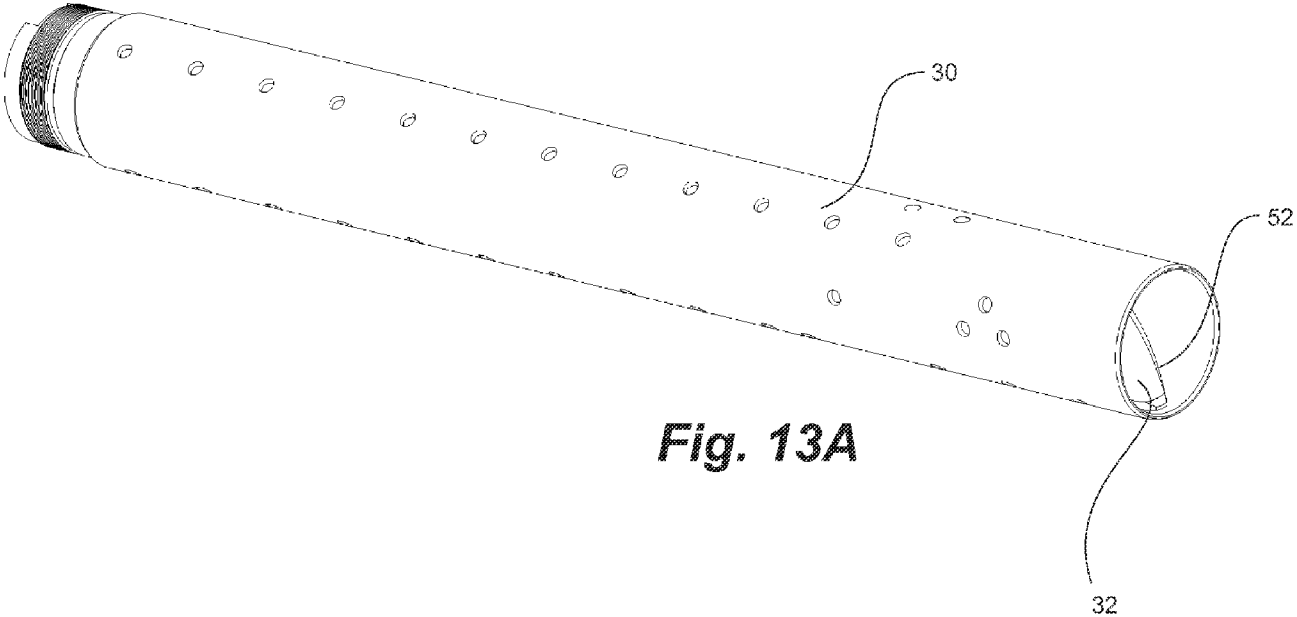
FIG. 13A is a perspective view of the moveable portion of the locator comprising a receptacle in a locating housing according to FIGS. 11A through 12B.
Figures 13C, 13D, 13E:
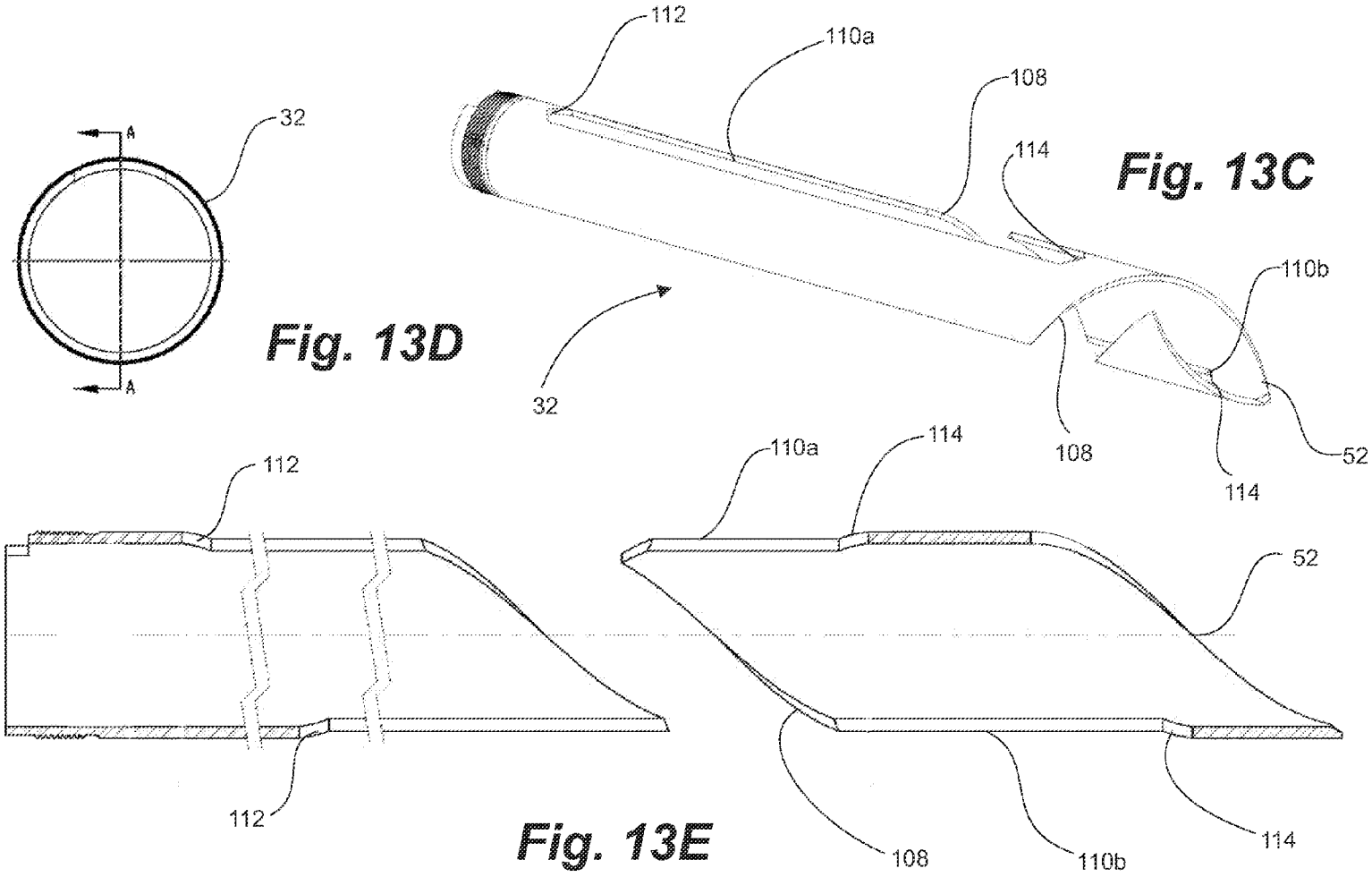
FIGS. 13C to 13E are view of the receptacle of FIG. 13A, the locating housing having been removed for clarity, more particularly.
Figures 14A, 14B, 14C, 14D:
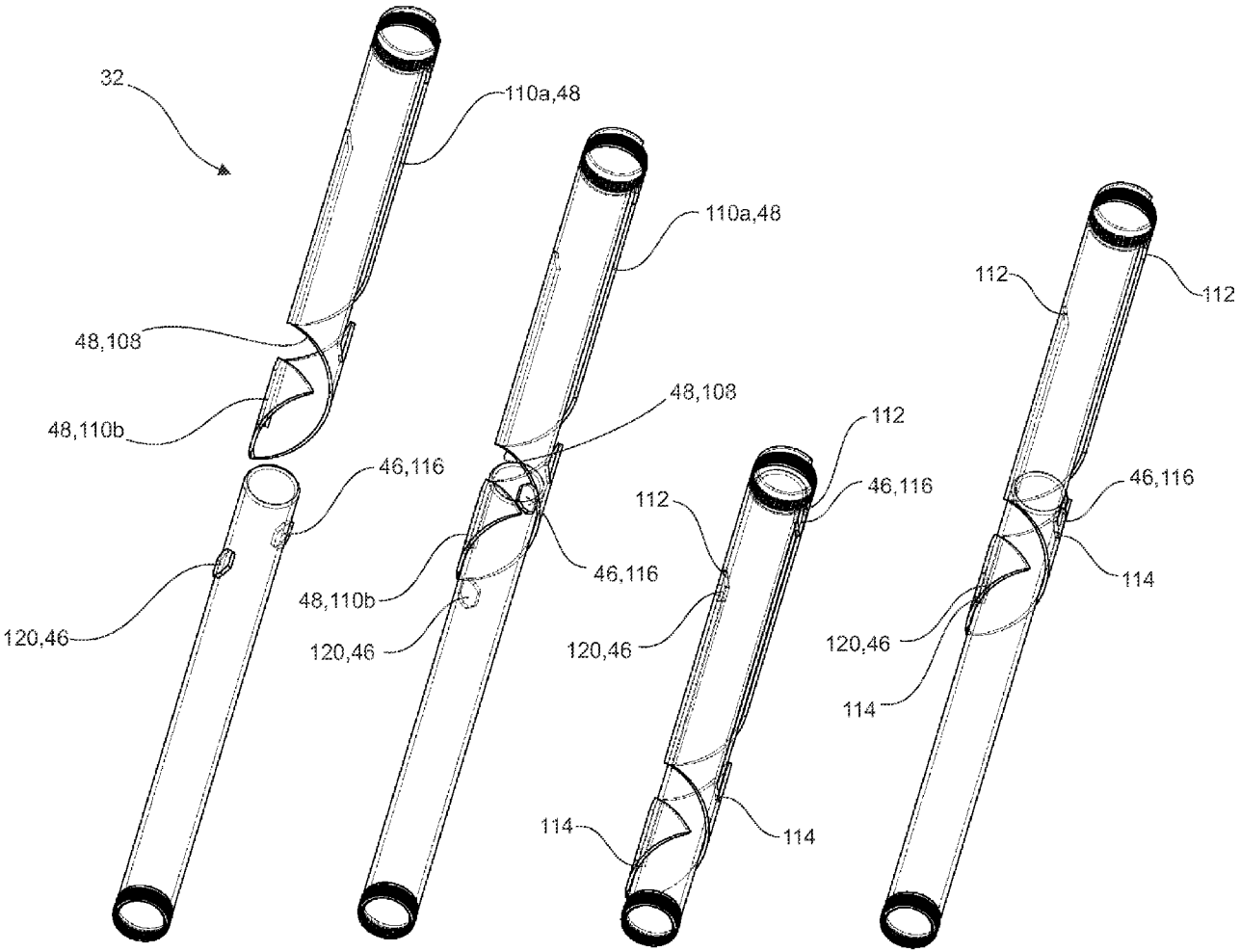
FIGS. 14A to 14D are sequential perspective views illustrating the coupling of a keyway in the receptacle of FIG. 13C with uphole and downhole axially spaced keys on the stationary portion of the locator according to FIG. 12A, more particularly.

As shown in FIGS. 12A and 12B, the wash tool assembly 16 is the same as that described for the previous embodiment with the exception of the form of the locator 100.

Thus, at least three trips are employed to conduct the operations for forming the discontinuous slot S and eroding the cavern. In a first trip, a first of the perforating guns 18 is run in, located and the first set of perforations P1 are formed. Tripping out the first of the guns 18, a second of the perforating guns 18 is run in, located, and the second set of perforations P2 are formed, slightly indexed from the first set of perforations P2 to form the discontinuous slot. Tripping out the second of the guns 18, the wash tool assembly 16 is run in, located, and reciprocated between delimited stops to erode a cavern along the discontinuous slot S.

In greater detail, and having reference to FIGS. 13A-13E, the receptacle 32 has the helical entrance 52 and the keyway 48. The helical entrance 52 acts to aid in guiding the receptacle 32 over the stationary latch body 44 and engaging the one or more corresponding keys 46 thereon in the corresponding keyway 48. The keyway 48 comprises a helical, transverse leg or entrance leg 108 for directing the one or more keys 46 into one or more corresponding and axially-extending legs 110*a*,110*b* . . . , each leg 110*a*,110*b* having a downhole end or downhole stop 112 and an uphole end or uphole stop 114. As the helical entrance 52 of the receptacle engages the one or more keys 46 on the latch body 44, the weight of the tubing string 17 and the helical entrance 52 urge or cause the receptacle 32, the locator housing 30, and the tubing string 17 to rotate, directing the one or more keys 46 into through the entrance leg 108 of the keyway 48. The tubing string 17 can be further rotated from surface as required to fully engage the one or more keys 46 in the keyway 48.

In the embodiment shown, there are two keys 46 protruding radially outwardly from the tubular latch body 44. The two keys 46 comprise a first uphole key 116 positioned adjacent an uphole end 118 of the latch body 44 and a second, downhole key 120. The downhole key 120 is spaced axially below and circumferentially, diametrically opposed to the uphole key 116. The keyway 48 further comprises first and second circumferentially diametrically opposed, axially extending legs 110*a*,110*b*. The downhole and uphole stops 112, 114 for each of the axially extending legs 110*a*,110*b* are axially spaced to match the spacing between the uphole and downhole keys 116, 120. Applicant believes use of two or more keys 46 provides greater strength of attachment between the receptacle 32 and the latch body 44.

Having reference to FIGS. 14A to 14D, as each of the perforating guns 34,36 and the wash tool assembly 16 are separately and sequentially lowered into the wellbore 14. The receptacle 32 of the respective locator 100 for each tool, gun 34,36 or wash tool assembly 16, being connected at a downhole end 122 thereof, is lowered onto and over the stationary latch body 44. The receptacle 32 is guided by the helical entrance 52 to accept the stationary latch body 44 into a bore 122 of the receptacle 32. As the receptacle 32 encounters the uphole key 116, the tubing string 17 is caused to rotate, engaging the entrance leg 108 of the keyway 48 therewith. Continued rotation, causes the second downhole key 120 to enter the entrance leg 108. Ultimately, the rotation positions the uphole and downhole keys 116,120 at the first and second diametrically opposed, axially extending legs 110*a*,110*b*. As the keys 116,120 align and are engaged in the axially extending legs 110*a*,110*b*, the weight of the tubing string 17, no longer supported by the helical entrance 52, places the tubing string 17 in tension, detected at surface. Thereafter, the tools 34,36,16 are set down fully, engaging the uphole and downhole keys 116, 120 with their respective downhole stops 112 of each of the axially extending legs 110*a*,110*b*. The tools 34,36,16 are fully latched within the locator 100 and cannot be released therefrom unless the tubing string 17 is again aligned with the helical entrance and rotated in an opposite direction. The rotation and the keyway 48 act to locate the tools 34,36,16 relative to one another such that the perforating guns 34,36 are located and positioned to form the discontinuous slot S and the wash tool assembly 16 is positioned to deliver non-abrasive fluid W therethrough as previously described.

Uncoupling of the tools 34,36,16 is accomplished by slowly lifting and perhaps lowering the tubing string 17, while rotating the tubing string 17 from surface in a direction opposite to the coupling direction, jockeying up and down as necessary until the downhole key 120 is directed into the entrance leg 108. Continued reverse rotation uncouples the downhole and uphole keys 120,116 from the keyway 48 permitting lifting of the moveable portion 22 of the locator 100 from the stationary portion 21 and enabling the tools 34,36,16 to be tripped from the wellbore 14.

In this embodiment, the uphole and downhole perforating guns 34,36 are separately run into the wellbore 14 and tripped out for sequentially locating in the wellbore 14 and forming their respective perforations. Firstly, after running in, the movable portion 22 of the first or second gun 34,36 is coupled with the stationary portion 21 of the locator 100, and is fully set down to engage with the downhole stop 112 in each axial leg 110*a*,110*b*. The first or second gun 34,36 is detonated for forming first perforations P1. A form of discontinuous slot S is formed, however, the overall access to the formation G can be too restrictive. The gun is uncoupled and tripped out of the wellbore 14. Secondly, and for providing greater access to the formation G, the other of the second or first gun 36,34 is run in, and the movable portion 22 is coupled with the stationary portion 21 of the locator 100, and fully set down to engage with the downhole stop 112 in each axial leg 110*a*,110*b*. The second or first gun 36,34 is detonated for forming the second perforations P2 and increasing the axial extent of the discontinuous slot S. The second or first gun 36,34 is uncoupled and tripped out of the wellbore 14.

Thirdly, the wash tool assembly 16 is threaded into the downhole end of the tubing string 17 and run into the wellbore 14 for engagement of its movable portion 22 of the locator 100 with the stationary portion 21 as described for the respective perforating guns 34,36. Once coupled, reciprocation of the wash tool assembly 16 between the downhole and uphole stops 112,114 of the first and second diametrically opposed, axially extending legs 110*a*,110*b* delimit the extent of the axial travel T of the wash tool assembly 16 engaged therein. The tubing string 17 is lifted and lowered for reciprocating the wash tool assembly 16 long the discontinuous slot S. During the reciprocation, the uphole and downhole keys 116,120 travel between the downhole and uphole stops 112, 114 of the axially extending legs 110*a*,110*b*.

Non-abrasive fluid W is delivered from the one or more nozzles 23 in the wash tool assembly 146 as previously described. As one of skill in the art will understand, orifices in the one or more nozzles 23 can be changed to provide different pressures and pumping rates.

Reciprocation or stroking of the wash tool assembly 16 is continued for a length of time sufficient to erode and remove formation materials G for forming the cavern C. The time required is generally dependent upon the formation G and may range from minutes to days.

By way of example, one or more nozzles 23 are capable of delivering 1 $m^3$ every 3 minutes at 2000 psi. In certain formations, Applicant believes a total wash volume of between about 10 $m^3$ to about 20 $m^3$ is required. The total wash volume can be delivered continuously or can be delivered in stages. The application of foam F may occur for some time, including for several days following the use of the wash tool assembly 16 to ensure substantially all of the debris which can be removed is removed. Typically, a geologist monitors the flowback to surface of the non-abrasive fluid W, the foam F and the debris entrained therewith during the operation of the wash tool assembly 16 and thereafter during continued foaming to determine the nature and amount of debris being removed from the formation G and may adjust the operational parameters accordingly.

The invention claimed is:

1. A method for forming slots in casing in a wellbore and for eroding the formation therebeyond for enhancing production of heavy hydrocarbons therefrom comprising:

running a perforating gun into the wellbore using a tubing string;

coupling the perforating gun having a moveable portion of a locator connected thereto to a stationary portion of the locator anchored in the wellbore downhole of a zone of interest for locating the perforating gun;

detonating the perforating gun for forming a discontinuous slot of spaced-apart perforations in the casing;

running a wash tool assembly into the wellbore using the tubing string;

coupling the wash tool assembly having the moveable portion of the locator connected thereto to the stationary portion of the locator for locating the wash tool assembly adjacent the discontinuous slot;

reciprocating the wash tool along the discontinuous slot, while simultaneously delivering a non-abrasive fluid from the wash tool assembly through the discontinuous slot to the formation for eroding the formation therebeyond and forming debris.

2. The method of claim 1 wherein at least while eroding the formation, the method further comprising flowing a foam into the casing for return to surface in the tubing string to aid in lifting the debris to surface.

3. The method of claim 1 wherein at least while eroding the formation, the method further comprising flowing a foam downhole through the tubing string for returning to surface in an annulus between the casing and the tubing string to aid in lifting debris to surface.

4. The method of claim 1, prior to running in and coupling the perforating gun, further comprising:

running in the stationary portion of the locator into the wellbore, downhole of a zone of interest; and setting an anchor for anchoring the stationary portion to the casing.

5. The method of claim 1, prior to running in and coupling the wash tool assembly, uncoupling the perforating gun; and tripping the perforating gun from the wellbore.

6. The method of claim 1 wherein the perforating gun comprises two or more spaced-apart perforating guns run into the wellbore on the tubing string, and the coupling and detonating of the two or more spaced-apart perforating guns comprises:

coupling a first perforating gun's moveable portion of the locator to the locator's stationary portion anchored in the wellbore downhole a zone of interest;

detonating the first perforating gun for forming first spaced-apart perforations in the casing;

coupling at least a second perforating gun's moveable portion of the locator to the locator's stationary portion anchored in the wellbore, the at least a second perforating gun being indexed axially relative to the first perforating gun; and detonating the at least a second perforating gun for forming second spaced-apart perforations in the casing, the first and second spaced-apart perforations forming the discontinuous slot.

7. The method of claim 6 wherein the perforating gun comprises two or more perforating guns, each of which is run in separately and sequentially into the wellbore on the tubing string, and wherein the coupling and detonating of the two or more separate perforating guns comprises:

running in and coupling a first perforating gun's moveable portion of the locator to the locator's stationary portion anchored in the wellbore downhole a zone of interest;

detonating the first perforating gun for forming first spaced-apart perforations in the casing;

uncoupling and tripping out the first perforating gun;

running in and coupling the at least a second perforating gun's moveable portion of the locator to the locator's stationary portion anchored in the wellbore, the at least a second perforating gun being indexed axially relative to the first perforating gun; and detonating the at least a second perforating gun for forming second spaced-apart perforations in the casing, the first and second spaced-apart perforations forming the discontinuous slot; and uncoupling and tripping out the at least a second perforating gun.

8. The method of claim 7 further comprising:

spacing the first perforating gun from its moveable portion of the locater using a first pup joint; and spacing the second perforating gun from its moveable portion of the locater using a second pup joint, the second pup joint having an axial length different than for the first pup joint for the first perforating gun.

9. The method of claim 1 wherein the coupling of the perforating gun and wash tool assembly comprises engaging one or more keyways of one of the movable or stationary portions of the locator with one or more corresponding keys of the other of the stationary or movable portions of the locator.

10. The method of claim 9 wherein locating of the perforating gun comprises lowering the perforating gun until the one or more keys is delimited by a downhole stop of the one or more corresponding keyways.

11. The method of claim 9 wherein locating of the wash tool assembly adjacent the discontinuous slot comprises:

lowering the tool until the one or more keys is delimited by a downhole stop of the one or more corresponding keyways;

raising the tool until the one or more keys is delimited by an uphole stop of the one or more corresponding keyways; and lifting and lowering the wash tool assembly using the tubing string between the uphole and downhole stops.

12. The method of claim 1 wherein, prior to reciprocating the wash tool and delivering non-abrasive fluid therefrom, the method further comprising:

running in coiled tubing through the tubing string; and fluidly and sealingly connecting the coiled tubing to one or more nozzles in the wash tool for flowing the non-abrasive fluid to the one or more nozzles.

13. A system for forming slots in casing in a wellbore and for eroding a formation therebeyond for forming a cavity in a zone of interest to enhance production of heavy hydrocarbons therefrom comprising:

one or more perforating guns having axially spaced shaped charges therein for perforating the casing and forming a discontinuous slot therethrough;

a wash tool assembly having one or more nozzles directed substantially orthogonal to the casing; and a locator having a stationary portion for anchoring in the wellbore downhole of the zone of interest; and a moveable portion connected to each of the one or more perforating guns and the wash tool assembly for staged and releasable coupling with the stationary portion, wherein when the locator's moveable portion is coupled with the stationary portion, the locator positions the one or more perforating guns at the zone of interest for forming the discontinuous slot; and thereafter positions the wash tool assembly adjacent the discontinuous slot and wherein when a non-abrasive fluid is delivered from the nozzles, the locator operatively delimits axial reciprocation of the wash tool along a length of the discontinuous slot for eroding the formation therebeyond.

14. The system of claim 13 wherein the first and second portions of the locator further comprise one or more keyways and one or more corresponding keys for engaging the one or more keyway.

15. The system of claim 14 wherein the keyway is formed in the moveable portion of the locator and the one or more corresponding keys are formed on the stationary portion of the locator.

16. The system of claim 15 wherein the moveable portion of the locator further comprises:

a tubular locator housing connected to a downhole end of the one or more perforating guns and the wash tool assembly; and a locating receptacle housed within the locator housing and having a helical entrance and a bore for receiving the stationary portion therein, the keyway formed within the receptacle and accessed through the helical entrance; and wherein the stationary portion of the locator further comprises:

a tubular latch body operatively connected to an anchor for anchoring in the casing; and the one or more keys extending radially outwardly from the latch body for engaging in the keyway.

17. The system of claim 16 wherein the keyway further comprises:

a helical entrance leg; and one or more axially extending legs having an uphole stop and a downhole stop for delimiting movement of the moveable portion of the locator, wherein when the keyway is rotated, the helical leg directs the one or more keys to the one or more axially extending legs.

18. The system of claim 17 wherein the one or more axially extending legs further comprise first and second circumferentially, diametrically opposed, axially extending legs.

19. The system of claim 18 wherein the one or more keys further comprise:

an uphole key positioned adjacent an uphole end of the latch body; and a downhole key spaced axially below and circumferentially, diametrically opposed to the uphole key, wherein each of the uphole and downhole keys engage within one of the first and second circumferentially, diametrically opposed, axially extending legs.

20. The system of claim 13 wherein the wash tool assembly further comprises:

a wash tool housing;

one or more nozzles in the housing for directing the non-abrasive fluid substantially orthogonal to the casing;

a falciform fluid passage in the housing connecting to the one or more nozzles and having an inlet end; and an adapter connected to the passage's inlet end for fluidly and sealing receiving coiled tubing therein for flowing the non-abrasive fluid through the passage to the one or more nozzles.

* * * * *